US005877388A

United States Patent [19]

Enda et al.

[11] Patent Number: 5,877,388

[45] Date of Patent: Mar. 2, 1999

[54] APPARATUS AND METHOD FOR ELECTROCHEMICAL DECONTAMINATION OF RADIOACTIVE METALLIC WASTE

[75] Inventors: Masami Enda, Yokohama; Katsumi Hosaka, Chigasaki; Hitoshi Sakai; Hideaki Heki, both of Yokohama, all of Japan

[73] Assignee: Kabushiki Kaisha Toshiba, Kawasaki, Japan

[21] Appl. No.: 870,450

[22] Filed: Jun. 6, 1997

Related U.S. Application Data

[63] Continuation of Ser. No. 381,513, Feb. 1, 1995, abandoned.

[30] Foreign Application Priority Data

Feb. 1, 1994 [JP] Japan ..... 6-010428
Aug. 31, 1994 [JP] Japan ..... 6-206644

[51] Int. Cl.[6] ..... A62D 3/00; C25B 9/00; C25D 17/00

[52] U.S. Cl. ..... 588/204; 204/704; 204/252; 204/225

[58] Field of Search ..... 588/204, 1; 204/DIG. 7, 204/140, 141.5, 144.5, 197, 228, 272, 260, 252, 225, 284; 205/704

[56] References Cited

U.S. PATENT DOCUMENTS

| | | | |
|---|---|---|---|
| 4,193,853 | 3/1980 | Childs et al. | 205/673 |
| 4,481,089 | 11/1984 | Izumida et al. | 204/129.43 |
| 4,663,085 | 5/1987 | Enda et al. | 252/626 |
| 4,828,759 | 5/1989 | Hanulik | 205/771 X |

FOREIGN PATENT DOCUMENTS

| | | |
|---|---|---|
| 2 565 021 | 11/1985 | France . |
| 60-186799 | 9/1985 | Japan . |
| 3-249600 | 11/1991 | Japan . |
| 5-297192 | 11/1993 | Japan . |

OTHER PUBLICATIONS

Patent Abstracts of Japan, vol. 017, No. 512 (P–1613), Sep. 14, 1993.

Patent Abstracts of Japan, vol. 016, No. 046 (P–1307), Feb. 5, 1992.

Database WPI, Section Ch. Week 9350; Derwent Publications Ltd. (No Date).

*Primary Examiner*—Donald R. Valentine
*Attorney, Agent, or Firm*—Foley & Lardner

[57] ABSTRACT

An insulating shield plate (1) divides a room of an electrolysis bath (2) into an anode chamber (13) and a cathode chamber (14). An anode (5) is disposed in the anode chamber (13), and a cathode (6), metallic waste (7) and heater (4) are disposed in the cathode chamber (14). An electrolyte (3) stored in the electrolysis bath (2) flows in a circulation path from a circulating pump (10) through a circulating line (12) and filter (11) to return the electrolysis bath (2). An exhaust gas processing device 9 is connected to the electrolysis bath (2). When a voltage is supplied to the anode (5) and cathode (6), a surface of the metallic waste (7) is charged in a positive polar to dissolve a base metal of the metallic waste (7). Further, a cylindrical anode (33) is arranged in an electrolyte (32) in an electrolysis bath (31), and a cylindrical metal (34) as a metallic waste is arranged in the cylindrical anode (33). After a bar-shape cathode (35) is arranged in the cylindrical metal (34), a DC voltage is supplied to the cylindrical anode (33) and the bar-shape cathode (35). At this time, the system may be constructed in that oxygen occurs by charging in a positive polarity an inner surface of the cylindrical metal (34) and the base metal of the cylindrical shape is dissolved.

15 Claims, 17 Drawing Sheets

APPARATUS AND METHOD FOR ELECTROCHEMICAL DECONTAMINATION OF RADIOACTIVE METALLIC WASTE

This application is continuation, of application Ser. No. 08/381,513, filed Feb. 1, 1995 now abandoned.

BACKGROUND OF THE INVENTION

The present invention relates to an apparatus and method for decontaminating a radioactive metallic waste for the purpose of reducing the radioactivity occurring during operation, outage for inspection and decommission of the nuclear facilities and included in a metallic waste, and more specifically, to an apparatus and method for decontaminating a radioactive metallic waste for the purpose of reducing the radioactivity included in metallic waste having shapes of a pipe, plate and the like.

Various methods are provided for completely decontaminating the radioactivity included in a radioactive metallic waste and occurring during operation of the nuclear power establishment, at an outage for inspection of the nuclear facilities and at decommissioning the waste. For example, Japanese Patent Laid-open No. 62-46297 and No. 60-186799 disclose an electrolysis decontamination using acid and neutral salt (chloride) solution, which have been developed and utilized.

The electrolysis decontamination is effective with respect to the metallic waste having a comparatively simple shape such as a plate, a cylindrical object and the like. A system of the electrolysis decontamination, comprises an anode as a metallic waste, and a cathode arranged in front of a surface to be decontaminated on the metallic waste as the anode, in which a direct voltage is supplied between the metallic waste (anode) and the cathode to polish a base metal on the surface to be decontaminated, thereby decontaminating the radioactivity from the metallic waste.

The electrolysis. decontamination mentioned above, however, has the problems as follows:

i) Since the contamination remains behind a connection portion between the metallic waste and the anode because the connection portion is not dissolved, it is necessary to change the manner of holding the anode to decontaminate again so as to complicate the decontamination;

ii) When large scale device and apparatus are decontaminated, since a current value becomes large in proportion to a surface area, it is necessary to provide an anode clamper under the consideration of a contact area. Accordingly, it is also necessary to frequently change the anode clamper to match the shape with the device and apparatus; and iii) When large number of device and apparatus are treated, since it is necessary to change the manner of holding the anode and to change the anode clamper, it is possible for an operator to receive an increased exposure.

A related patent application has been filed at the JPO as Japanese patent application laid-open No. 5-297192, and No. 6-242295 for decontaminating the radioactivity of the metallic waste by using a bipolar electrolytic with non-contact. The present invention provides higher function and high performance than the previous methods.

SUMMARY OF THE INVENTION

In view of the above-mentioned conditions, an object of the present invention is to provide a system and method for a decontamination of radioactive metallic waste, capable of removing radioactivity or decreasing radioactive level of the metallic waste in a short time where it is unnecessary to change a clamp of an electrode and perform an attachment of the electrode and taking out of the electrode operation before and after a decontamination.

For achieving the above object, there is a fundamental component of the system and method for a decontamination radioactive metallic waste according to the present invention as follows:

There is provided a system for decontaminating radioactivity of a metallic waste by performing a bipolar electrolytic with non-contact in an electrolyte in an electrolysis bath with respect to a metallic waste contaminated by radioactive material and by dissolving a base metal by dielectric function so as to remove radioactivity, comprising an electrolysis bath having a predetermined shape and filled up by an electrolyte which has predetermined component, density and temperature for performing the electrolysis;

an anode arranged in the electrolysis bath with a predetermined shape and charged in a positive polar by a direct current (DC) voltage supplied from a DC power source; and a cathode arranged in the electrolysis bath with a predetermined shape and charged in a negative polar by the DC voltage supplied from the DC power source:

wherein the predetermined shape of at least any of electrodes of the anode and cathode is formed in correspondence with the predetermined shape of the metallic waste which is set in the electrolysis bath.

Furthermore, there is a system for decontaminating radioactivity of the metallic waste according to the above construction, further comprising an insulating shield plate for dividing a room of the electrolysis bath into an anode chamber and a cathode chamber, and the insulating shield plate which is set in a U-shape along three inner wall surfaces of the electrolysis bath.

There is provided a system for decontaminating radioactivity of the metallic waste according to a construction in the above paragraph, wherein the insulating shield plate is a vessel having an opening at an upper portion thereof;

the anode is arranged at a bottom portion of the electrolysis bath;

the cathode is arranged at a bottom portion of the electrolysis bath;

the metallic waste is supported by an insulation supporting member; and the insulation supporting member is arranged at the bottom of the electrolysis bath having the opening at the upper portion and has a plurality of holes each of which opens in a mesh-shape for passing through the electrolyte.

There is provided a system for decontaminating radioactivity of the metallic waste according to a construction in the above paragraph, wherein the insulation supporting member is comprised of a basket which has an opening at an upper portion thereof, and stores the metallic waste therein.

There is a system for decontaminating radioactivity of the metallic waste according to a construction in the above paragraph, wherein the cathode is comprised of a rectangular pipe or a bar-shaped body, and moves with keeping a constant interval against the metallic waste by a driving mechanism.

There is provided a system for decontaminating radioactivity of the metallic waste according to a construction of the above paragraph, wherein the cathode is comprised of a blind cathode which is formed by connecting a plurality of rectangular pipes or bar-shaped bodies by a flexible cable, the blind cathode which has an insulating elastic body for allowing a water passing therethrough.

There is a system for decontaminating radioactivity of the metallic waste according to a construction of the first paragraph, wherein any one of electrodes of two kinds of the anode and the cathode for electrolysis has a cylindrical shape along the outer shape of the metallic waste having a curved portion, and the other of the electrodes is formed in a bar-shape in correspondence with an inner shape of the metallic waste.

There is provided a system for decontaminating radioactivity of the metallic waste according to a construction of the seventh paragraph, wherein the system comprises an electrolysis bath;

a cylindrical anode which is arranged in the electrolyte in the electrolysis bath;

a cylindrical metallic waste which is arranged in the cylindrical anode;

a bar-shape cathode which is arranged in the cylindrical metallic waste; and a direct current power source for connecting the cylindrical anode and the bar-shape cathode.

There is provided a system for decontaminating radioactivity of the metallic waste according to a construction of the seventh paragraph, wherein the system comprises an electrolysis bath;

a cylindrical insulating shield body which is arranged in the electrolyte in the electrolysis bath;

a cylindrical anode which is arranged on an inner wall of the cylindrical insulating shield body;

a cylindrical cathode which is arranged on an outer wall of the cylindrical insulating shield body;

a cylindrical metallic waste which is arranged in the cylindrical anode; and a direct current power source for connecting the cylindrical anode and the bar-shape cathode.

There is provided a system for decontaminating radioactivity of the metallic waste according to a construction of a ninth paragraph, wherein insulating discs each having an opening are arranged at the upper and lower ends of the cylindrical insulating shield body.

There is provided a system for decontaminating radioactivity of the metallic waste according to the construction on the seventh paragraph, wherein the system comprises an electrolysis bath;

an insulating shield vessel which is arranged in the electrolysis bath and has an opening at the upper portion thereof;

a cathode which is arranged at the bottom of the electrolysis bath;

an anode which is arranged at the bottom of the insulating shield vessel;

a supporting vessel which is arranged in the insulating shield vessel to keep a metallic waste and has an opening at the upper portion thereof: wherein the supporting vessel has a side surface formed of insulating material, and a bottom portion formed of metal material, and the side surface of the supporting vessel has a plurality of holes for allowing the electrolyte therethrough.

There is provided a system for decontaminating radioactivity of the metallic waste according to a construction of an eleventh paragraph, wherein an electric circuit is configured in the manner that the DC voltage is supplied between the anode and the cathode for charging in a negative polarity metal material at the bottom portion of the supporting vessel facing to the anode, and for charging in a positive polarity an upper surface of the metallic waste kept by the supporting vessel.

Furthermore, a method for decontaminating radioactivity of a metallic waste, at least including a step of performing a bipolar electrolytic with non-contact to the metallic waste contaminated by radioactive material and in an electrolyte in an electrolysis bath, and a step of dissolving a base metal of the metallic waste by dielectric function, is provided thereby eliminating radioactivity; comprising a step of filling up the electrolyte having predetermined component, density and temperature into an electrolysis bath having a predetermined shape for performing the electrolysis;

a step of setting the metallic waste at a predetermined position between a pair of electrodes including an anode and cathode and corresponding to the shape of the metallic waste; and a step of supplying a direct current (DC) voltage from a DC power source to the pair of electrodes to charge in a positive polarity any one of the pair of electrodes to be the anode and to charge in a negative polarity the other of the pair of electrodes to be the cathode for performing the electrolyte, thereby dissolving the base metal of the metallic waste.

There is provided a method of decontaminating radioactivity of the metallic waste according to the thirteenth paragraph, further comprising a step of dividing a room in the electrolysis bath into an insulating shield plate into an anode chamber and a cathode chamber;

a step of setting an anode in the anode chamber;

a step of setting a cathode and the metallic waste in the cathode chamber;

a step of supplying the DC voltage to the anode and cathode from the DC power source connected to the anode and cathode, respectively; and a step of charging in a positive polar to a decontamination surface of the metallic waste facing to the cathode.

There is provided a method of decontaminating radioactivity of the metallic waste according to the fourteenth paragraph, wherein when entire of both surfaces of the metallic waste are contaminated by the radioactivity, a polarity of the DC power source is converted to change the anode to a cathode and the cathode to an anode so as to dissolve the other surface of the metallic waste.

There is provided a method of decontaminating radioactivity of the metallic waste according to the fourteenth paragraph, further comprising a step of using inorganic acid as the electrolyte;

a step of supplying the DC voltage to the pair of electrodes;

a step of reducing and destroying a passive or oxide layer on the predetermined surface of the metallic waste facing to the cathode by charging in a negative polar to the other surface of the predetermined surface; and a step of stopping a supply of the DC voltage and dissolving the base metal of the metallic waste by using acid force of the inorganic acid.

There is provided a method of decontaminating radioactivity of the metallic waste according to the sixteenth paragraph, wherein a dissolution of the base metal and a reduction and destruction of the passive or oxide layer are repeated by alternatively inverting a polarity of the DC power source.

There is provided a method of decontaminating radioactivity of the metallic waste according to the thirteenth paragraph, comprising a step of setting a cylindrical anode in the electrolyte;

a step of setting a cylindrical metallic waste in the cylindrical anode;

a step of setting a bar-shape cathode in the cylindrical metallic waste;

a step of supplying the DC voltage from the DC power source to a portion between the cylindrical anode and the bar-shape cathode; and a step of charging in a positive polar to an inner surface of the cylindrical metallic waste and in negative polar to an outer surface of the cylindrical metallic waste, thereby dissolving the inner surface of a base metal of the metallic waste.

There is provided a method of decontaminating radioactivity of the metallic waste according to the eighteenth paragraph, wherein when both of the inner surface and the outer surface of the cylindrical metallic waste are contaminated, a cathode of the DC power source is inverted to an anode, and an anode of the DC power source is inverted to a cathode, thereby dissolving the outer surface of the cylindrical metallic waste.

There is provided a method of decontaminating radioactivity of the metallic waste according to the eighteenth paragraph, wherein a dissolution of the base metal of the inner surface of the cylindrical metallic waste and a reduction and destruction of the oxide layer formed on the inner surface of the cylindrical metallic waste are repeated by alternatively inverting a polarity of the DC power source.

There is provided a method of decontaminating radioactivity of the metallic waste according to the thirteenth paragraph, comprising a step of setting a cylindrical insulating shield body in the electrolyte;

a step of setting a cylindrical anode on an inner wall of the cylindrical insulating shield body, a step of setting a cylindrical cathode on an outer wall of the cylindrical insulating shield body;

a step of setting a cylindrical metallic waste in the cylindrical anode;

a step of connecting the DC power source to the cylindrical anode and the cylindrical cathode;

a step of supplying the DC voltage from the DC power source to the cylindrical anode and cylindrical cathode; and a step of charging in a negative polarity an outer surface of the cylindrical metallic waste and in a positive polarity an inner surface of the cylindrical metallic waste, thereby dissolving a base metal at an inner surface of the cylindrical metallic waste.

There is provided a method of decontaminating radioactivity of the metallic waste according to claim the twenty-first paragraph, wherein when both of the inner surface and the outer surface of the cylindrical metallic waste are contaminated, a cathode of the DC power source is inverted to an anode, and an anode of the DC power source is inverted to a cathode, thereby dissolving the outer surface of the cylindrical metallic waste.

There is provided a method of decontaminating radioactivity of the metallic waste according to the twenty-first paragraph, wherein a dissolution of the base metal of the inner surface of the cylindrical metallic waste and a reduction and destruction of the oxide layer formed on the inner surface of the cylindrical metallic waste are repeated by alternatively inverting a polarity of the DC power source.

DETAILED DESCRIPTION OF THE PREFERRED EMBODIMENTS

There will be described in detail an apparatus and method for decontaminating a radioactivity of a metallic waste according to preferred embodiments of the present invention in reference with the attached drawings.

Figure 1:
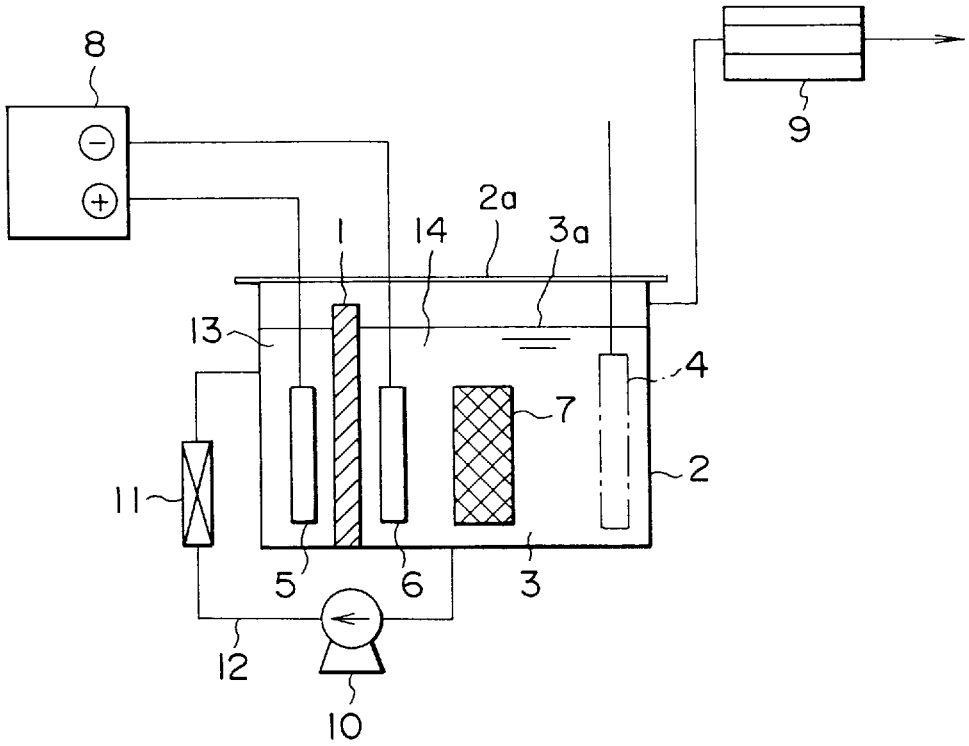
FIG. 1 is a system diagram showing a decontamination system for decontaminating a radioactivity of a metallic waste according to first and fourth embodiments of the present invention.
Figure 2:
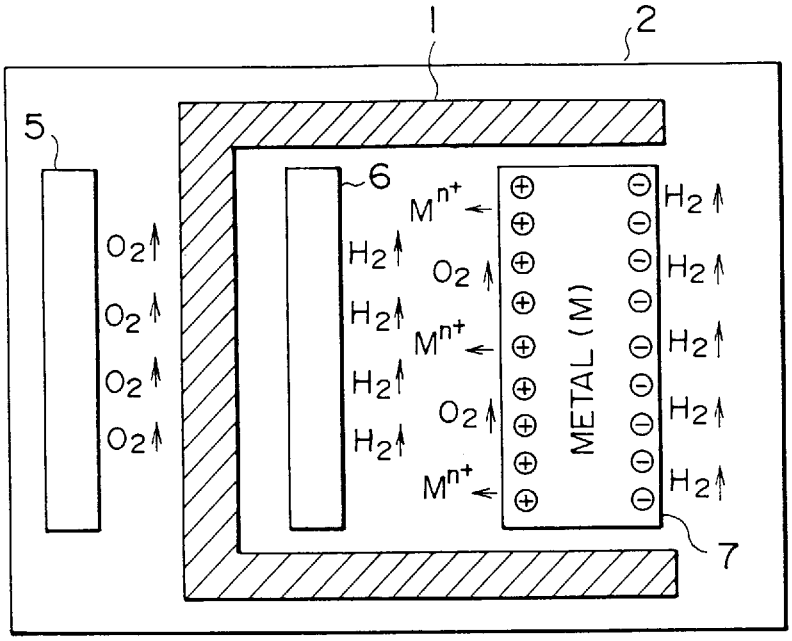
FIG. 2 is a plan view showing an electrolysis bath in the decontamination system according to the first and fourth embodiments shown in FIG. 1.
Figure 3:
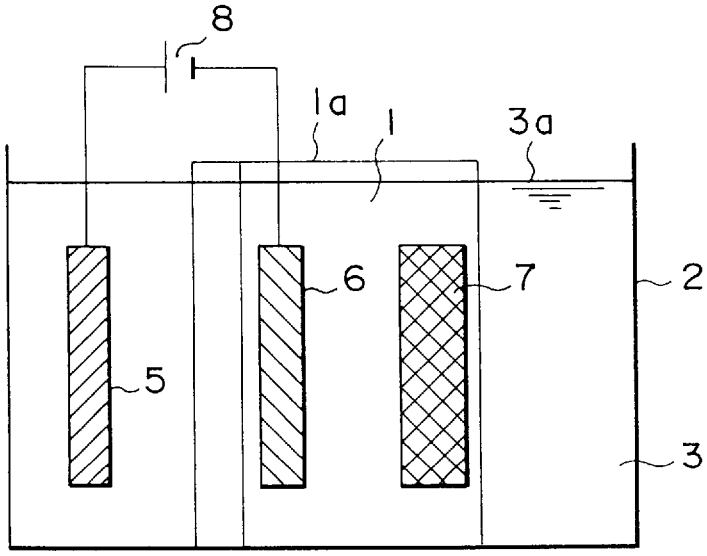
FIG. 3 is a longitudinally sectional view showing the electrolysis bath in the decontamination system according to the first and fourth embodiments shown in FIG. 1.

There is described a system for decontaminating a radioactivity of a metallic waste according to first and fourth embodiments of the present invention in reference with FIGS. 1–3. FIG. 1 is a system -diagram showing an example with respect to the first and fourth embodiments. In FIG. 1, numeral 1 denotes an insulating shield plate, and 2 denotes an electrolysis bath which includes a lid 2*a*, an electrolyte 3, and an electrolyte heater 4.

The electrolysis bath 2 is divided into an anode chamber 13 and a cathode chamber 14. The anode chamber 13 has an anode 5 comprised of a deactivate metal, the cathode chamber 14 has a cathode 6 and a metallic waste 7, and the anode 5 and the cathode 6 are connected with a direct current power source 8, respectively.

An exhaust gas treating system 9 is connected to an upper portion of the electrolysis bath 2 to treat the steam and gas generated from the electrolyte 3. The electrolyte 3 circulates through the electrolysis bath 2, a filter 11 and an electrolyte circulation line 12 by a circulating pump 10.

Next, there is described an electrolysis reaction in the method for decontaminating the radioactivity of the metallic waste according to the first embodiment of the present invention by commonly using FIG. 2 showing a plan view of the electrolysis bath 2 and FIG. 3 showing a longitudinally sectional view of the electrolysis bath 2.

The insulating shield plate 1 is formed in a shape of a character "U" as shown in FIG. 2, the cathode 6 is arranged on an inner surface of the insulating plate 1, the anode 5 is arranged on an outer surface of the insulating plate 1, and the anode 5 faces the cathode 6 with the insulating plate 1 between.

On the other hand, the radioactive metallic waste 7 is grounded in the opposite direction to the anode 5 in the manner of facing the cathode 6. An ion in the electrolyte 3 moves only in a gap between the insulating shield plate 1 and a side wall of the electrolysis bath 2, and an upper end 1*a* of the insulating shield plate 1 is provided higher than a liquid surface 3*a* of the electrolyte 3 and a lower end 1*b* of the insulating shield plate 1 is connected to a bottom portion of the electrolysis bath 2, in order to prevent the ion to move through upper and lower portions of the electrolysis bath 2. Furthermore, the quality of the material is an insulating material or a metal lined with an insulating material.

In this condition, the circulating pump 10 circulates the electrolyte 3 and the electrolyte heater 4 heats the electrolyte 3 to a predetermined temperature. Then, when the DC power source 8 supplies a DC voltage having a predetermined current density to a portion between the anode 5 and the cathode 6, a reaction represented by the following equations (1)–(3) occurs with respect to the anode 5, cathode 6 and the metallic waste 7 so as to cause a surface (M) of the metallic waste 7 to be charged of a positive electrode by a dielectric function so as to be resolved:

$$\text{(anode)} \quad H_2O \longrightarrow 2H^+ + 1/2.O_2 \uparrow + 2e^- \quad (1)$$

$$\text{(cathode)} \quad H^+ + 2e^- \longrightarrow H_2 \uparrow \quad (2)$$

$$\text{(metallic waste)} \quad M \longrightarrow M^{n+} + ne^- \quad (3)$$

The radioactivity fixed to the metallic waste 7 or permeated in the base metal is eliminated from the metallic waste 7 to move into the electrolyte 3 by dissolving the base metal, thereby decontaminating the radioactivity or decreasing the radioactivity level of the metallic waste 7.

When the metallic waste 7 is contaminated over the entire surface, the polarity of the DC power source 8 is inverted to charge an opposite surface to be positive so as to dissolve the base metal. On the other hand, the exhaust gas treating system 9 treats the mist, steam, gas and the like occurring from the electrolyte 3.

Figure 4:
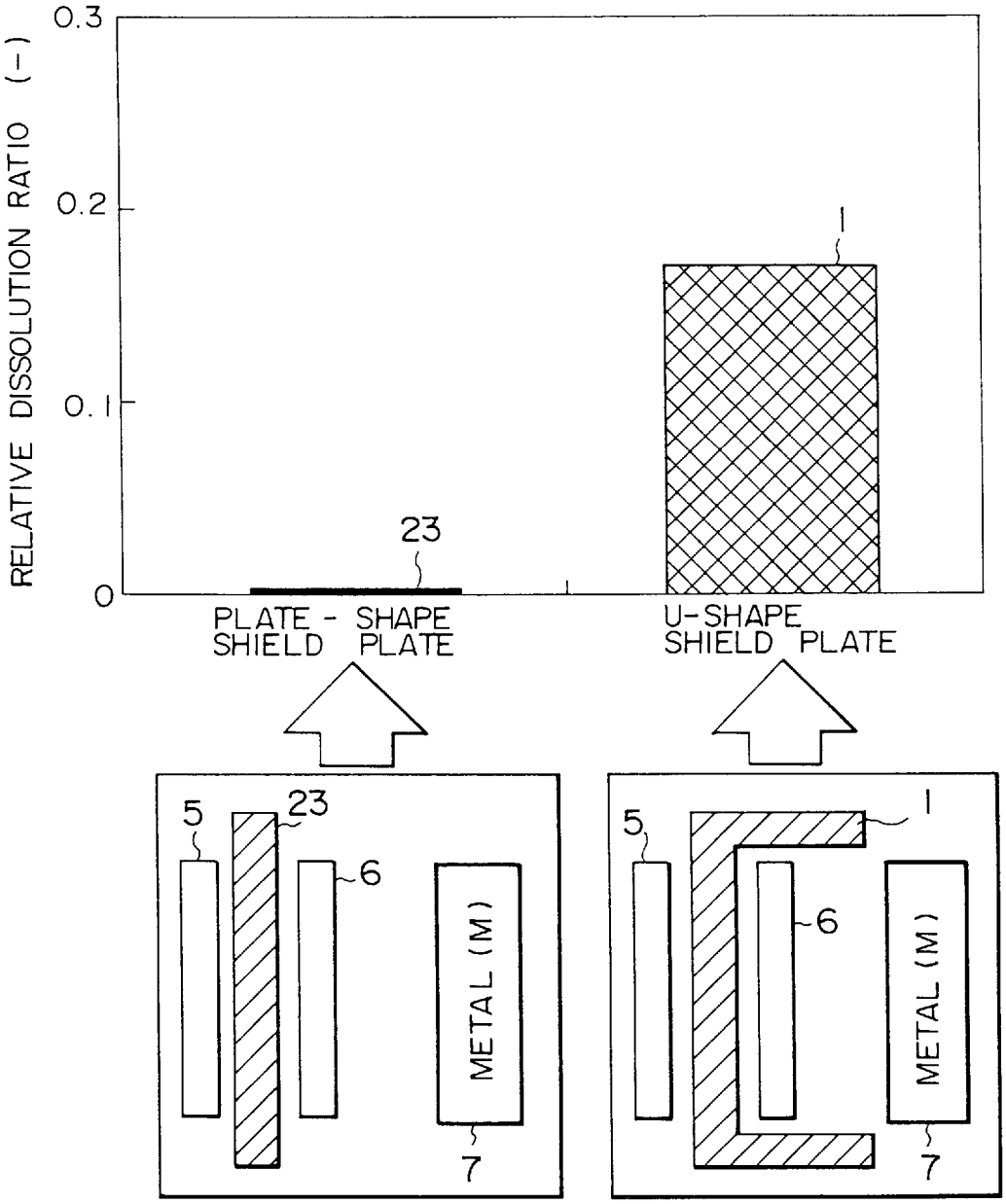
FIG. 4 is an experimental/theoretical view for explaining a system for decontaminating a radioactivity of a metallic waste according to a second embodiment of the present invention.

There is described a system according to a second embodiment of the present invention in accordance with FIG. 4, which shows a relative dissolution ratio (an experimental value/theoretical value) in comparison with stainless steels in any cases when the insulating shield plate is a simple plate-shape shield plate 23 and when the insulating plate is the U-shape insulating plate 1.

In the second embodiment, sulfuric acid is selected as an acid electrolyte, which has a concentration of 0.5 mol/L and an electrolyte temperature of 80° C., and an electrolysis is performed by supplying a DC voltage having a current density of 0.6 A/cm$^2$ to a portion between the anode and cathode which are comprised of titanium coated by platinum.

As understood from FIG. 4, even though the stainless steel is hardly not dissolved when the insulating shield plate is the simple plate 23, it is possible to obtain a relative dissolution ratio of 0.2 when the plate is the U-shape insulating shield plate 1. A cause of this is that the electrolysis between the anode and cathode is prior to everything because the anode is near the cathode even though the simple plate of the insulating shield plate is provided between the anode and cathode when the insulating shield plate is the simple plate 23.

On the other hand, when the U-shape insulating shield plate 1 is used, an electric field between the cathode and anode is shut out by the plate-shaped stainless steel. Therefore, the leaking of current decreases between the anode and cathode.

Since the distance between the anode and cathode becomes far away by the U-shape insulating shield plate 1, the supplied voltage increases. When a bipolar electrolytic with non-contact dissolves a metal, it is necessary to supply an overpotential larger than an equilibrium potential of a metal dissolving reaction. Accordingly, when a voltage supplied between the anode and cathode becomes large, it is possible to efficiently dissolve the base metal by supplying an overvoltage larger than an equilibrium potential for dissolving a stainless steel.

Furthermore, for causing the distance between the anode 5 and the cathode 6 to be distant and making the distance between the cathode 6 and the metallic waste 7 be near, it is possible to enlarge the size of the electrolysis bath 2. However, in this case, an increase of the liquid amount of the electrolyte 3 causes an occurring amount of a secondary waste (a decontaminated waste fluid) to be also increased. However, since there is provided the U-shape insulating shield plate 1, it is possible to leave a space between the anode 5 and the cathode 6 without the increase of the capacity of the electrolysis bath 2.

As described above, since the second embodiment of the present invention uses the U-shape shield plate 1, it is possible to efficiently dissolve the metallic waste, to decontaminate a radioactivity of the metallic waste, and to decrease the radioactivity level.

Figure 5:
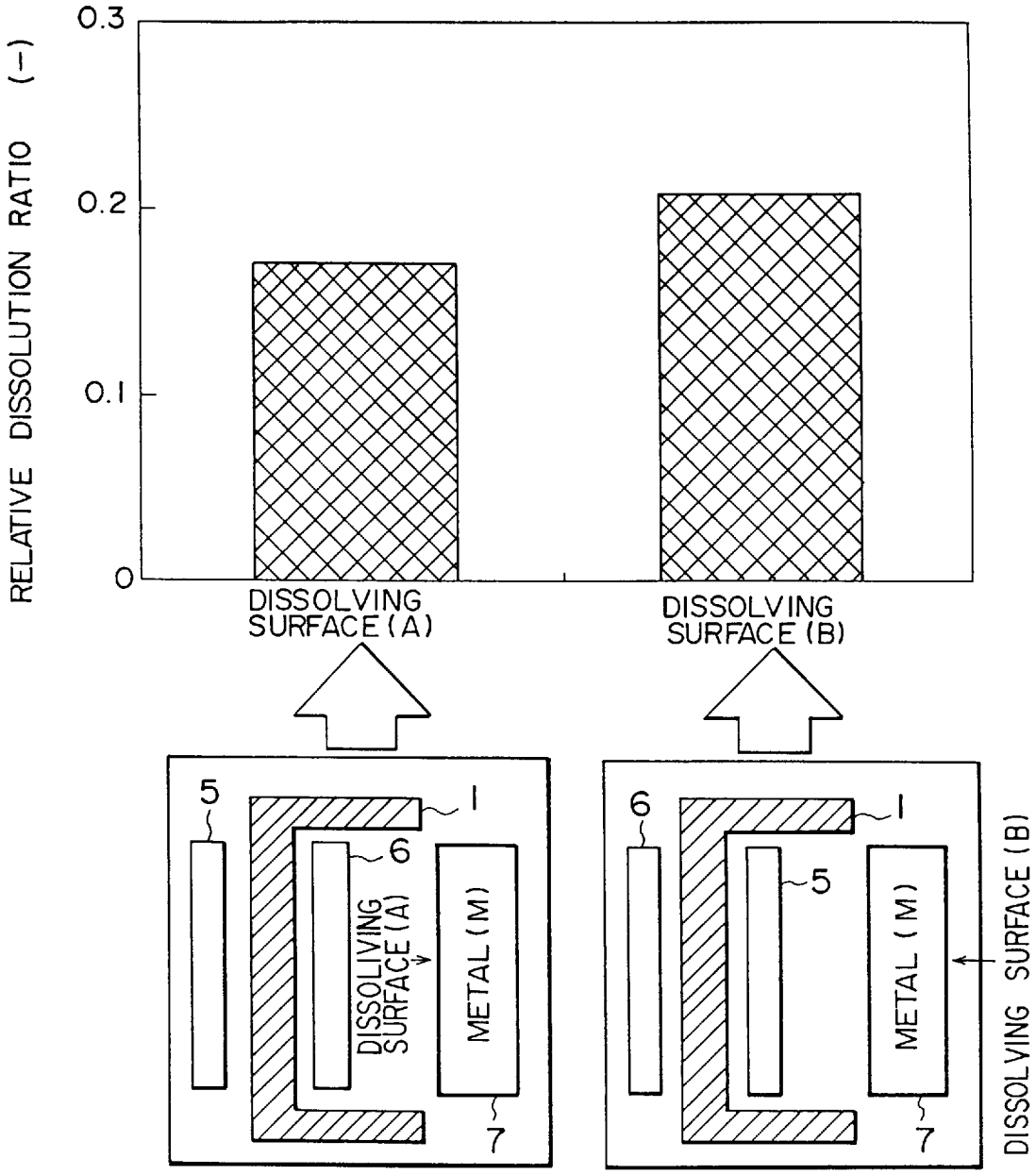
FIG. 5 is an experimental/theoretical view for explaining a system for decontaminating a radioactivity of a metallic waste according to a third embodiment of the present invention.

Next, there is described a system for decontaminating a radioactivity of a metallic waste according to a third embodiment of the present invention in accordance with FIG. 5 showing a relative dissolution ratio (an experimental/theoretical value) when both surfaces of a plate-shape metal (a stainless steel) are dissolved by inverting a polarity of a direct current power source. In the third embodiment, an electrolysis is performed by supplying a DC voltage to a portion between the anode 5 and the cathode 6 of titanium coated by platinum under the condition that an acid electrolyte is comprised of sulfuric acid having a density of 0.5 mol/L and 80° C. of a temperature.

Even though the stainless steel is not dissolved when the insulating shield plate is formed from the simple plate 23 as shown in FIG. 4, it is possible to obtain a relative dissolution ratio 0.2 when the shield plate is the U-shape shield plate 1.

The reason resides in that the electrolysis between the anode and the cathode is rapid because the cathode is near the anode even through the insulating shield plate when the plate is the simple plate 23.

On the other hand, since an ion must move along the U-shape shield plate and the side wall of the electrolyte bath to reach to the inner cathode when the plate is the U-shape shield plate 1, the distance between the cathode and anode is shorter than the distance between the cathode and the stainless steel, thereby resulting a little current for leaking the portion between the cathode and anode.

Furthermore, the supplied voltage increases because of the a large distance between the anode 5 and the cathode 6 through the U-shape shield plate 1. When a metal is dissolved by a bipolar electrolytic with non-contact, the metal surface must be supplied an overpotential larger than an equilibrium potential of the metal dissolving reaction. Accordingly, when the large voltage is supplied to a portion between the anode and. the cathode, it is possible to efficiently dissolve the base metal by supplying a potential larger than the equilibrium potential for dissolving the stainless steel.

Even though it is possible to lengthen the distance between the anode 5 and the cathode 6 and to shorten the distance between the cathode 6 and the metallic waste 7 by enlarging the size of the electrolyte bath 2, this case results in an increase of the generated amount of the secondary waste (a decontamination waste liquid) with the decontamination because the liquid amount of the electrolyte 3 increases. However, the U-shape shield plate 1 can enlarge the distance between the anode 5 and the cathode 6 without increasing the capacity of the electrolysis bath 2.

As describe above, since the second embodiment of the present invention uses the U-shape insulating shield plate 1, it is possible to effectively dissolve the metallic waste to decontaminate the radioactivity of the metallic waste, thereby decreasing the radioactivity level.

Next, there is described a third embodiment with reference to FIG. 5 showing a relative dissolution ratio (an experiment/theory value) when both surfaces of the plate-shaped metal (a stainless steel) are dissolved by inverting the polarity of a DC power source. In the same way as the second embodiment shown in FIG. 4, the third embodiment uses sulfuric acid selected as an acid electrolyte, which has a concentration of 0.5 mol/L and an electrolyte temperature of 80° C., and an electrolysis is performed by supplying a DC voltage having a current density of 0.6 A/cm$^2$ to a portion between the anode and cathode which are comprised of titanium coated by platinum.

As clearly understood from the third embodiment, it has been possible to efficiently dissolve both surface (a dissolved surface (A) and a dissolved surface (B)) of the plate-shaped stainless steel by inverting the polarity of the DC power source. A dissolving reaction of the dissolved surface (B) causes one surface of the metallic waste 7 facing the anode 5 to have a negative polarity with an electrostatic charge, and the other surface of the metallic waste 7 to have a positive polarity, with an electrostatic charge, thereby dissolving the dissolved surface (B).

As described above, the provision of the U-shape insulating shield plate 1 can efficiently dissolve an entire surface of the metallic waste 7 only by inverting a polarity of the DC power source, thereby decontaminating the radioactivity or reducing the radioactivity level of the metallic waste 7. If the electrolyte of the present invention is comprised of phosphoric acid, nitric acid, sodium sulphate or sodium nitrate without sulfuric acid according to the second embodiment, the same effect can be obtained.

Accordingly, the inversion of a polarity of the DC power source can change from the anode chamber to the cathode chamber and from the cathode chamber to the anode chamber. Any embodiment can be provided to the present invention as far as the insulating shield plate decontaminates the radioactivity of the metallic waste.

Next, there is describe a decontamination system according to a fourth embodiment of the present invention with reference to FIGS. 1 and 2. In the fourth embodiment, sulfuric acid solution is selected as the electrolyte 3, the anode 5 is arranged in the anode chamber 13 which is divided by the insulating shield plate 1, the cathode 6 and metallic waste 7 are arranged in the cathode chamber 14, the electrolyte 3 circulates by the circulation pump 10 to increase a temperature to a predetermined value by the electrolyte heater 4, and the DC voltage is supplied from the DC power source 8 to a portion between the anode 5 and the cathode 6 during a predetermined time interval.

The supply of the DC voltage results in a reaction shown by the equation (1) around the anode 5 to generate oxygen gas, and results in a reaction shown by the equation (2) around cathode 6 to generate hydrogen gas. On the other hand, one surface of the metallic waste 7 facing the cathode 6 has an electrostatic charge of the positive polarity, and the other surface of the waste 7 has a charge of the negative polarity.

Here, even though the waste 7 is easy to be dissolved by sulfuric acid and nitric acid when the metallic waste 7 is a carbon steel, it is difficult to dissolve when an oxide layer and rust are attached on the entire surface of the waste. Since the stainless steel has a passive state layer on its surface, the stainless steel has excellent anti-corrosion characteristics. However, if the surface of the stainless steel or carbon steel is charged to the negative polarity, a reaction shown by the following equations (4) and (5) happens on the surface so as to reduce and eliminate the passive state layer, oxide layer and rust on the surface.

Metallic waste (negative charged surface):

Passive layer, oxide layer:

$$Fe_3O_4+8H^++2e^-\rightarrow 3Fe^{2+}+4H_2O \quad (4)$$

Reduction of rust:

$$Fe_2O_3+6H^++2e^-\rightarrow 2Fe^{2+}+3H_2O \quad (5)$$

In the above manner, after the passive state layer, oxide layer or rust is reduced and eliminated from the surface of the metallic waste 7, the base metal is exposed to be activated. Under the condition, a stop of the DC voltage supply from the DC power source makes the metallic waste to be dissolved by the oxidizing force of sulfuric acid.

If the anode 5 in the anode chamber 13 changes to a cathode and the cathode 6 in the cathode chamber 14 changes to an anode by converting the polarity of the DC power source 8 so as to cause the surface of the metallic waste 7 facing the converted anode to a negative polarity by an electrostatic charge, the decontamination is performed in the same manner.

Accordingly, radioactivity, which is attached on the metallic waste with the oxide layer or soaks into the base metal, moves into the electrolyte with the oxide layer which is removed from the metallic waste by reducing the oxide layer and dissolving the base metal, thereby decontaminating the radioactivity and decreasing the radioactivity level of the metallic waste.

Figure 6:
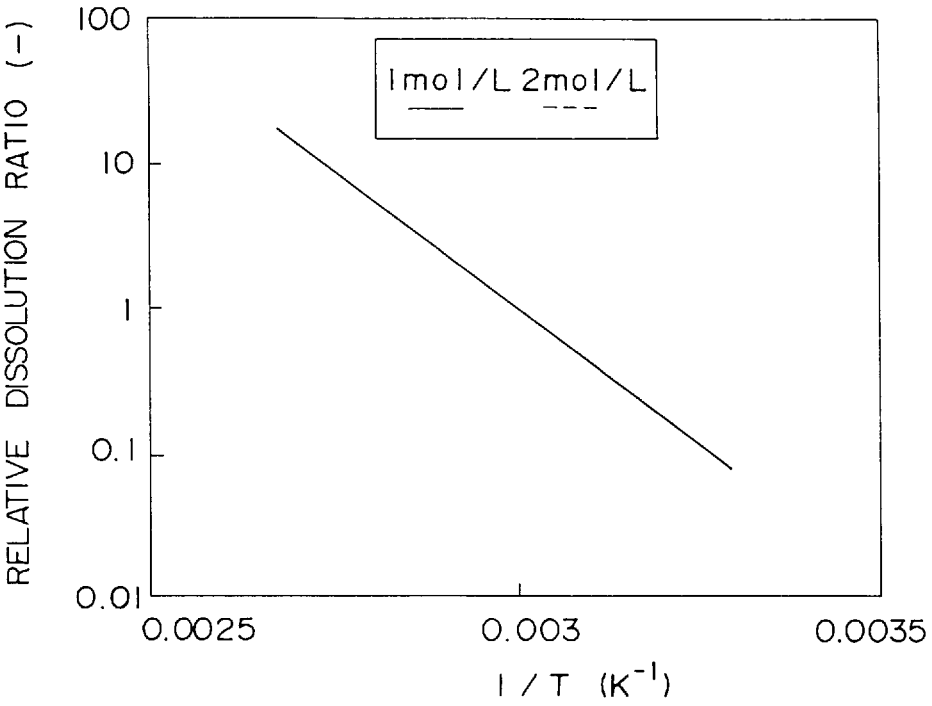
FIG. 6 is a characteristic diagram showing a relationship between a solubility and a reciprocal of an absolute temperature of an electrolyte for explaining a system for decontaminating a radioactivity of a metallic waste according to a fifth embodiment of the present invention.

Next, there is described a decontamination system according to a fifth embodiment for recognizing an effect of the system according to the fourth embodiment, with reference to FIG. 6. In the fifth embodiment, a dissolving experimentation is performed with a stainless steel (SUS 304) by supplying the DC voltage of 5 V for five minutes to a portion between the anode and cathode made of titanium coated by platinum in sulfuric acid having a density of 1 mol/L and 2 mol/L.

In FIG. 6, a longitudinal axis denotes a relative dissolution ratio (a dissolution ratio at each temperature against a dissolution ratio at 60° C.), and a horizontal axis denotes an inverse of an absolute temperature of the electrolyte. A dissolution ratio of a stainless steel has a linear relationship with the inverse of the absolute temperature, and increases by an exponent function with the temperature of the electrolyte.

As described above, the decontamination system according to the fifth embodiment can reduce a radioactivity level or decontaminate the radioactivity of the metallic waste because an electrostatic charge of a negative polarity makes a surface of the metallic waste be easily dissolved by the oxidizing force of sulfuric acid. Accordingly, the system of the present invention can apply to an electrolysis decontamination which has conventionally been difficult to decontaminate for a complex shaped object such as a curved pipe or curved valve. The electrolyte using the electrolyte of the fifth embodiment can change from sulfuric acid to nitric acid or chloric acid so as to obtain the same effect.

Figure 7:
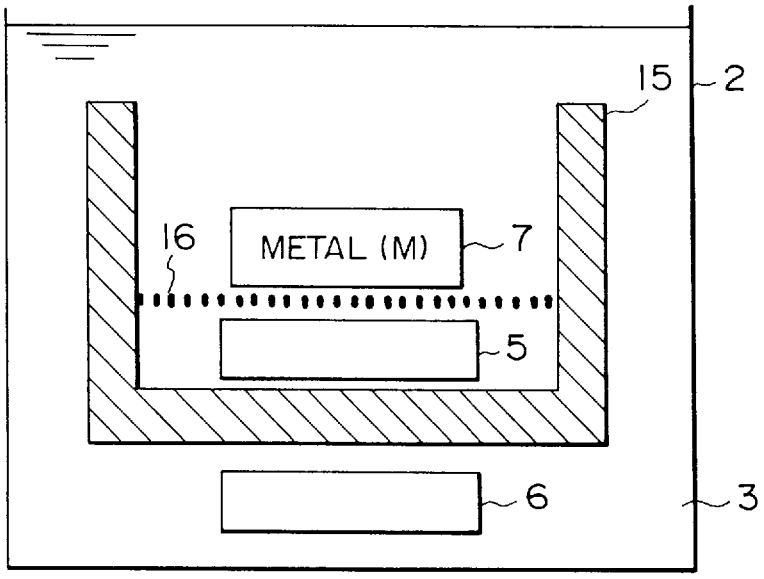
FIG. 7 is a longitudinally sectional view showing a system for decontaminating a radioactivity of a metallic waste according to a sixth embodiment of the present invention.

Next, there is described a decontamination system according to a sixth embodiment of the present invention with reference to FIG. 7 showing a longitudinal cross section of the electrolysis bath 2. In FIG. 7, numeral 15 denotes a shielded vessel having an insulation and an opening portion at an upper end, the anode 5 is arranged at a bottom of the shielded vessel 15, a supporting member 16 having an insulation and a mesh-shape is arranged at an upper end of the anode 5, and a cathode 6 is arranged at a bottom portion of the electrolysis bath 2 by putting a bottom portion of the shielded vessel 15 therebetween.

The metallic waste 7 is stored in the shielded vessel 15 and supported by the insulation supporting member 16 to which a plurality of through holes are opened in a mesh-shape for passing therethrough the electrolyte and oxygen gas so as not to contact the metallic waste 7 to the anode 5.

Under the condition, when a DC voltage is supplied to a portion between the anode 5 and cathode 6, a surface opposite to the anode 5 of the metallic waste 7 is charged in electrostatic to a positive polarity because an ion in the electrolyte moves and passes through the holes of the supporting member 16. This charge causes the electrolyte to generate a dissolving reaction shown in FIG. 3, thereby decontaminating the radioactivity and decreasing the radioactive level of the metallic waste.

Accordingly, the shielded vessel 15 having the opening at the upper portion according to the sixth embodiment can increase the decontamination treated amount of the metallic waste per each batch.

Figure 8:
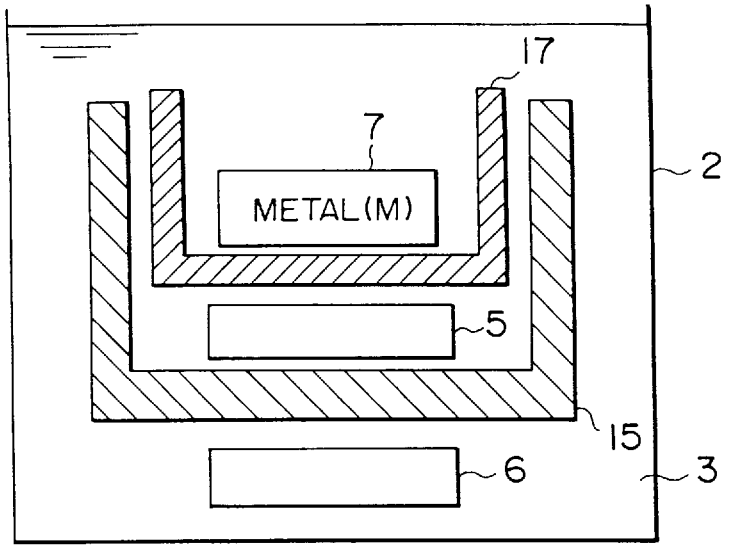
FIG. 8 is a longitudinally sectional view showing a system for decontaminating a radioactivity of a metallic waste according to a seventh embodiment of the present invention.

Next, there is described a decontamination system according to a seventh embodiment with reference to FIG. 8 showing a longitudinal cross section of the electrolysis bath 2. In FIG. 8, numeral 17 is an insulating basket having an opening at an upper portion, in which a metallic waste 7 is stored. The basket 17 is arranged in the insulating shielded vessel having the opening at its upper portion. The anode 5 is arranged at a bottom of the shielded vessel 15, and the cathode 6 is arranged at a bottom of the electrolysis bath 2 in the manner of putting the bottom of the shielded vessel 15 therebetween.

Under this condition, when a DC voltage is supplied to a portion between the anode 5 and cathode 6, a surface opposite to the anode 5 of the metallic waste 7 is charged in electrostatic to a positive polarity because an ion in the electrolyte moves and passes through the holes of the supporting member 16. This charge causes the electrolyte to generate a dissolving reaction shown in FIG. 3, thereby decontaminating the radioactivity and decreasing the radioactive level of the metallic waste.

Accordingly, the insulating basket 17 having the opening at the upper portion according to the seventh embodiment also can increase the decontamination treated amount of the metallic waste 7 per each batch in the same manner as the sixth embodiment. Furthermore, since the insulating basket 17 can be stored and taken out by using the driving mechanism in and from the electrolysis bath 2, it becomes easy to automatically perform mass processing.

When the systems according to the first through third embodiments are combined with the systems according to the fourth through sixth embodiments or the system according to the fourth embodiment, it is possible to alternatively repeat oxidization and reduction on the surface of the metallic waste 7 by inverting the polarity of the DC power source at each predetermined time. By this, it is possible to selectively eliminate an oxide layer and rust by reducing them as a contamination source of the metallic waste 7.

After that, since it is possible to decontaminate and decrease the radioactivity and its level by little dissolving amounts of the base metal when an oxidization dissolves the base metal, it is possible to decrease an amount of the secondary waste in accordance with the decontamination.

Accordingly, since the seventh embodiment has an effect for the metallic waste made of the carbon steel which has thick oxide layer and rust including a radioactivity and strongly fixed on its surface, a repeated processing of oxidization and reduction can remove the radioactivity in a short time, thereby decreasing the radioactive level.

Figure 9:
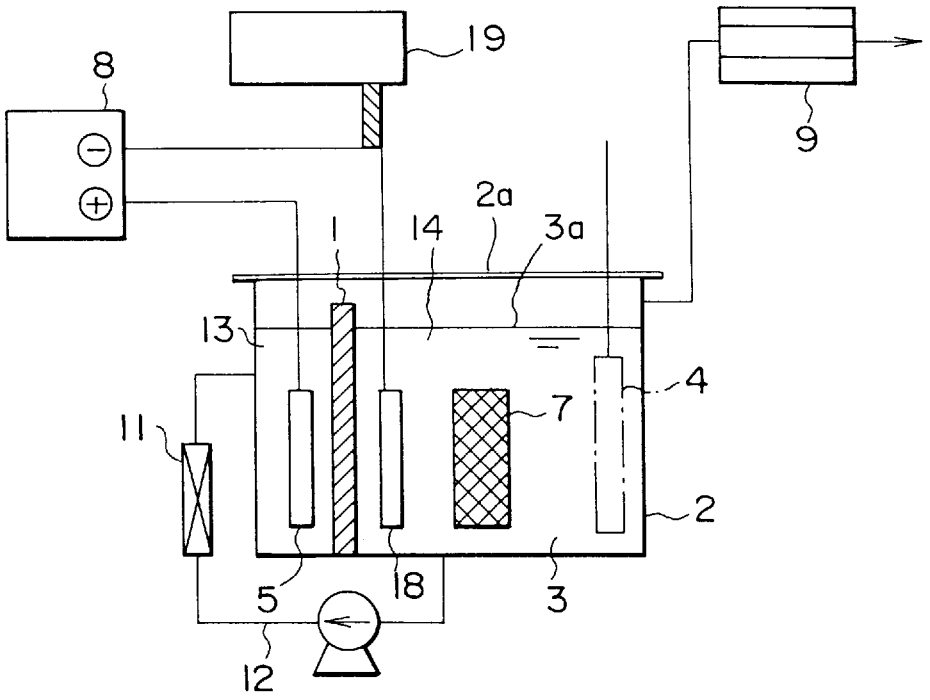
FIG. 9 is a system diagram showing a system for decontaminating a radioactivity of a metallic waste according to an eighth embodiment of the present invention.
Figure 10:
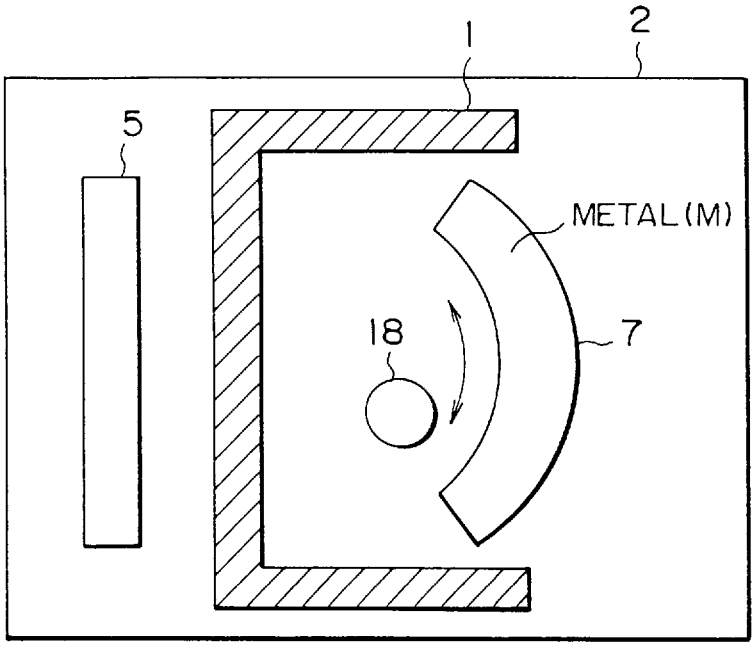
FIG. 10 is a plan view showing an arrangement relationship between a bar-shape cathode in an electrolysis bath and a curved metallic waste shown in FIG. 9.

There is described a decontamination system according to an eighth embodiment of the present invention with reference to FIGS. 9 and 10. FIG. 9 is a system diagram showing an example of a system for explaining the eight embodiment, in which numeral 1 denotes the insulating shield plate, 2 is the electrolysis bath including the electrolyte 3 and storing the electrolyte heater 4.

The electrolysis bath 2 is divided into the anode chamber 13 and cathode chamber 14 by the insulating shield plate 1. The anode 5 made of inert metal is stored in the anode chamber 13, and the metallic waste 7 and the cathode 18 are stored in the cathode chamber 14. The cathode 18 has a bar shape or a rectangular pipe shape which is made of the inert metal, and the anode 5 and the cathode 18 are respectively connected to the DC power source 8.

Furthermore, an exhaust gas processing system 9 is connected to the upper portion of the electrolysis bath 2 for processing steam and gas occurring from the electrolyte 3. The electrolyte 3 circulates in the electrolysis bath 2, filter 11 and electrolyte circulation line 12 by the circulation pump 10.

There is described an operation for decontaminating the radioactivity of the metallic waste according to the eighth embodiment of the present invention with reference to FIG. 10 showing a plan view of the electrolysis bath 2 shown in FIG. 9.

The insulating shield plate 1 has the U-shape having an inner surface to which the bar-shaped or rectangular-shaped cathode 18 is arranged and faced, and an outer surface to which the anode 5 is arranged and faced. The cathode 18 and anode 5 are arranged to face each other by putting the insulating waste 1 therebetween.

On the other hand, the metallic waste 7 is grounded in the direction opposite to the insulating shield plate 1 for facing the cathode 18. An ion in the electrolyte 3 moves in only a gap between the insulating shield plate 1 and the side wall of the electrolysis bath 2, and the upper portion of the shield plate 1 is higher than a liquid surface 3*a* of the electrolyte 3 and the lower portion of the shield plate 1 is connected to the bottom portion of the electrolysis bath 2 in order to prevent an ion from moving through the upper and lower portions of the electrolysis bath 2.

Furthermore, the material of the electrolysis bath 2 is the insulating material or the metal coated by an insulating material. In this condition, the circulation pump 10 circulates the electrolyte 3 to increase the temperature to a predetermined value by the electrolyte heater 4 so as to supply a DC voltage having a predetermined current density from the DC power source 8 to a portion between the anode 5 and cathode 18.

When the driving mechanism 19 moves the cathode 18 by keeping a predetermined interval against the surface of the metallic waste 7, the surface of the metallic waste (M) against the cathode 18 is dissolved by a reaction shown in the equation (3) on the basis of the dielectric function.

When the decontamination is performed with respect to the curved plate, if the plate-shaped cathode is used, since the distance between the cathode and the surface of the metallic waste becomes partially different from each other, it is possible to leave a partial contamination. In the eighth embodiment, since the bar-shaped or pipe-shaped cathode 18 is used to decontaminate the radioactivity by moving by keeping the predetermined gap against the metallic waste surface by the driving mechanism 19, it is possible to uniformly dissolve the metal surface, thereby equally decontaminating the radioactivity after preventing the partial remaining contamination.

When the metallic waste before decontaminated has a partial contamination, the dissolution of the entire contaminated surface increases an occurring amount of the secondary waste. However, since the system according to the eighth embodiment can decontaminate by moving the bar-shaped or pipe-shaped cathode near to the contaminated portion of the metallic waste, it is possible to largely decrease the occurring amount of the secondary waste in comparison to the dissolution of the entire metal surface.

Accordingly, when the decontamination is performed by moving the bar-shaped or pipe-shaped cathode by the driving mechanism, the metallic waste having the curved plate can be even decontaminated for its surface. Furthermore, since the partial contamination can be contaminated within this region, it is possible to improve an application for the shape of the metallic waste, thereby largely decreasing the occurring amount of the secondary waste with the decontamination.

Figure 11:
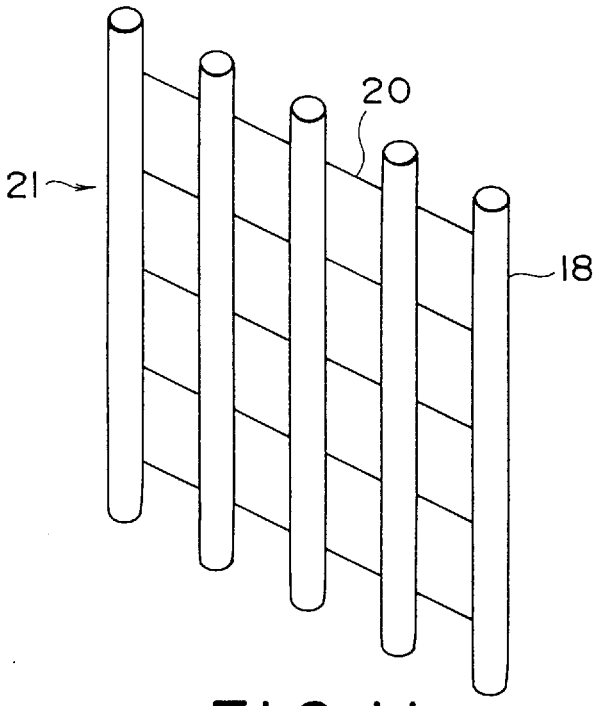
FIG. 11 is a perspective view showing a first blind-shape cathode set in an electrolysis bath shown in FIG. 9.
Figure 12:
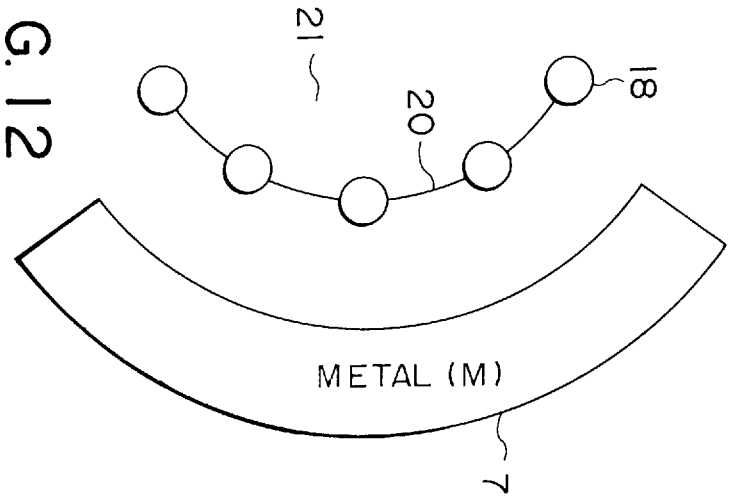
FIG. 12 is a front view showing a set condition of the first blind-shape cathode in the curved metallic waste shown in FIG. 11.
Figure 13:
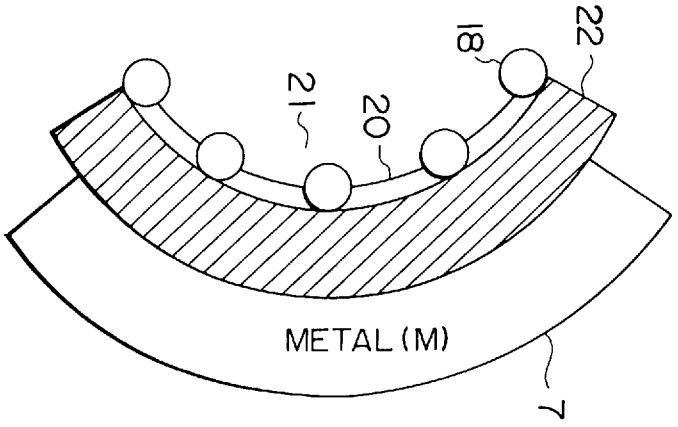
FIG. 13 is a front view showing a set condition of a second blind-shape cathode in the curved metallic waste shown in FIG. 9.

Next, there are described two modified examples of the eighth embodiment with respect to the method and system for decontaminating the radioactivity with reference to FIGS. 11 through 13. FIG. 11 shows a first example of the blind-shaped cathode 21 in which a plurality of bar-shaped cathodes 18 are arranged in a blind shape by means of a connection by a flexible cable 20, thereby freely bending a portion of the flexible cable 20.

FIG. 12 shows a case in which the blind-shape cathode 21 shown in FIG. 11 is used for the curved metallic waste 7. Since the blind shape cathode 21 can be bent at a portion of the flexible cable 20, the cathode 21 changes to the curved shape along the shape of the metallic waste 7, thereby uniformly decontaminating the radioactivity on the metal surface by keeping a predetermined interval against the surface of the metallic waste.

FIG. 13 shows a second example in which an insulating elastic body 22 allowing a water passing through is attached with the blind shape cathode 21. The insulating elastic body 22 can prevent the blind shape cathode 21 and metallic waste 7 from a contact and can keep the distance between the metallic waste 7 and blind shape cathode 21 to a predetermined degree, thereby uniformly decontaminating the radioactivity on the surface of the metallic waste 7. The insulating elastic body 22 can be utilized by a material such as a rubber having a plurality of holes or a sponge.

In the above-mentioned system or method for decontaminating a radioactivity of the metallic waste according to the embodiments of the present invention, since the electrolysis occurs on the wall surface of the electrolysis bath by a dielectric function when the material of the vessel is metal, it is impossible to efficiently charge with electrostatic to a positive or negative polar on the surface of the metallic waste.

Accordingly, the electrolysis bath, insulating shield plate, shield vessel, supporting member in the shield vessel and basket are made of the simple of the insulating materials having a chemical-proof material such as a fluorocarbon polymer, fiber reinforced plastic (FRP) and the like, or metal lined by the insulating member. Furthermore, the shape of the electrolysis bath, shield vessel and basket are not limited in the rectangular shape and may be applicable to cylindrical shape.

Furthermore, it is possible to utilize electrodes which are made of cooper coated by titanium further coated by platinum, simple platinum electrode, metal except titanium coated by platinum, and lead compound electrode, in addition to titanium coated by platinum as a material of the electrode used in the above embodiment.

Figure 14:
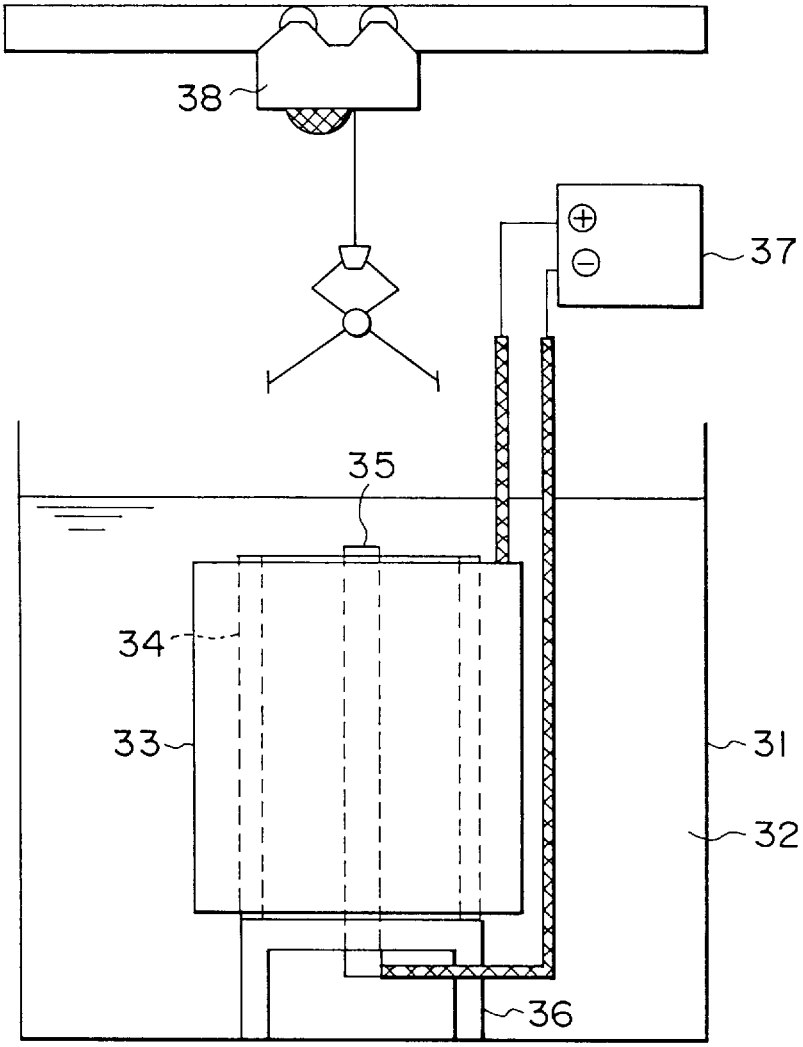
FIG. 14 is a system diagram showing a schematic constitution of a system for decontaminating a radioactivity of a metallic waste according to ninth and thirteenth embodiment of the present invention.
Figure 15A:
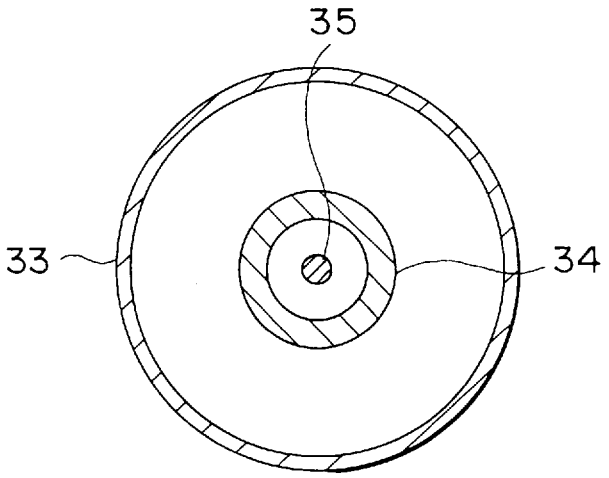
FIGS. 15A and 15B are a cross sectional view and a longitudinally sectional view respectively and schematically showing an important portion of an electrolysis bath shown in FIG. 14.
Figure 15B:
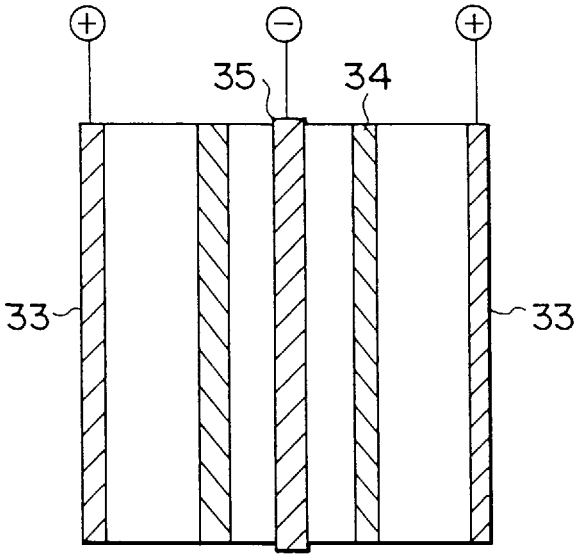
Figure 16:
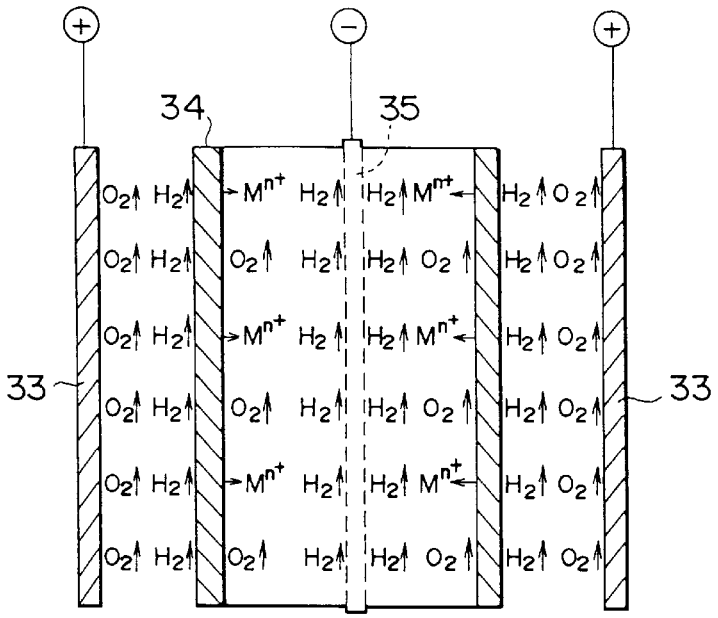
FIG. 16 is a model view for explaining an electrolysis reaction shown in FIG. 15B.

There is described a system for decontaminating a radioactivity of the metallic waste according to a ninth embodiment of the present invention with reference to FIGS. 14–16. FIG. 14 is a longitudinal sectional view showing an example of an electrolysis bath for explaining the system according to the ninth embodiment. In the figure, numeral 31 denotes an electrolysis bath, in which an electrolyte 32 is filled up. There are provided in the electrolyte 32 a cylindrical anode 33, a cylindrical metal 34 as a radio-active metallic waste for an object and enclosed by the cylindrical anode 33, and a bar-shape cathode 5 in the cylindrical metal 34.

The cylindrical metal 34 is fixed on a platform 36, and the cylindrical anode 33 and the bar-shape cathode 35 are connected to a direct current power source 37. A handling mechanism 38 is arranged at the upper portion of the electrolysis bath 31 for storing and taking the cylindrical metal 34 in and out the vessel 31.

There is described in detail a positional relationship between the cylindrical anode 33, cylindrical metal 34 and bar-shape cathode 35 with reference to FIGS. 15A and 15B, in which FIG. 15A is a plan view of the system and FIG. 15B is a longitudinal sectional view of the system. The cylindrical metal 34 is arranged at the center of the cylindrical anode 33, the bar-shape cathode 35 is arranged at the center of the cylindrical metal 34, and the DC power source 37 is connected to the cylindrical anode 33 and the bar-shape cathode 35, respectively.

Under this condition, when a DC voltage is supplied from the DC power source 37 to a portion between the cylindrical anode 33 and the bar-shape cathode 35, a reaction shown in FIG. 16 occurs on the surface of the cylindrical anode 33 and between an inner surface of the cylindrical metal 34 and an outer surface of the bar-shape cathode 35. The followings are principle of the above reaction:

(anode) $H_2O \longrightarrow 2H^+ + 1/2.O_2\uparrow + 2e^-$ (1')

(cathode) $H^+ + 2e^- \longrightarrow H_2\uparrow$ (2')

(outer of metal) $H^+ + 2e^- \longrightarrow H_2\uparrow$ (6)

(inner of metal) $M \longrightarrow M^{n+} + ne^-$ (3')

Since the outer surface of the cylindrical metal 34 faces the cylindrical anode 33, the outer of the metal 34 is charged in a negative polarity by the dielectric function. Since the inner surface of the cylindrical metal 34 faces the bar-shape cathode 35, the inner surface is charged in a positive polarity, thereby dissolving the inner surface of the base metal.

By this, the dissolution of the base metal decontaminates the radioactivity which is fixed on the inner surface of the cylindrical metal 34 or soaked into the base metal from the metal 34 to move into the electrolyte 32, thereby decontaminating the radioactivity or decreasing the radioactivity level of the cylindrical metal 34.

Figure 17:
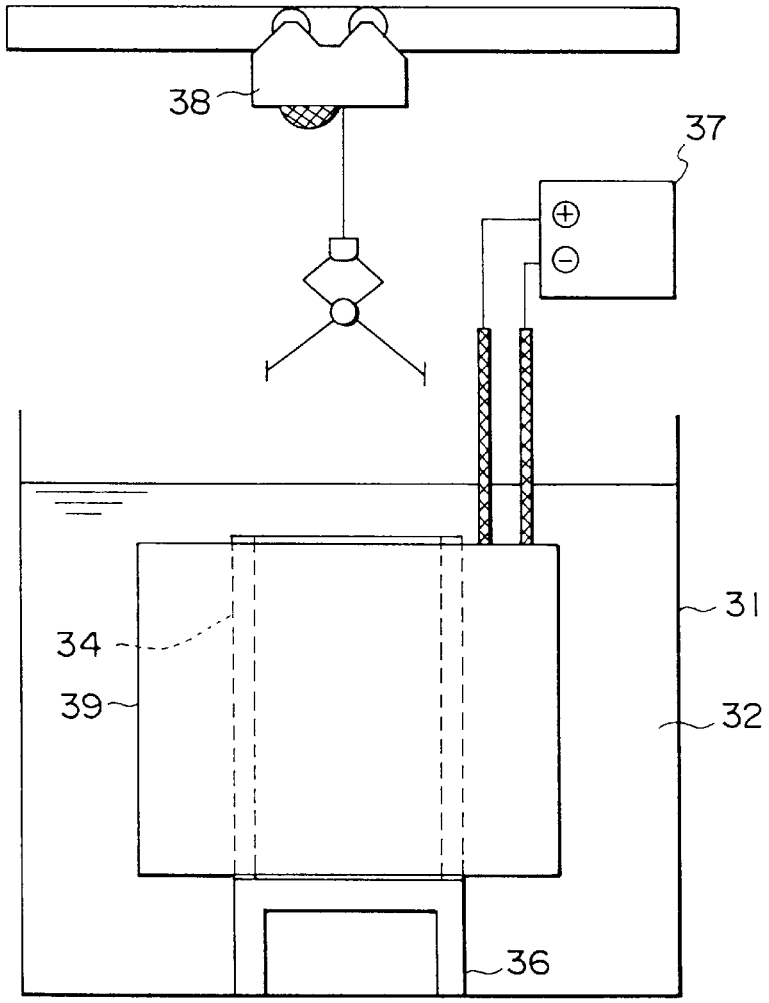
FIG. 17 is a system view showing a, schematical constitution of a system for decontaminating a radioactivity of a metallic waste according to a tenth embodiment of the present invention.
Figure 18A:
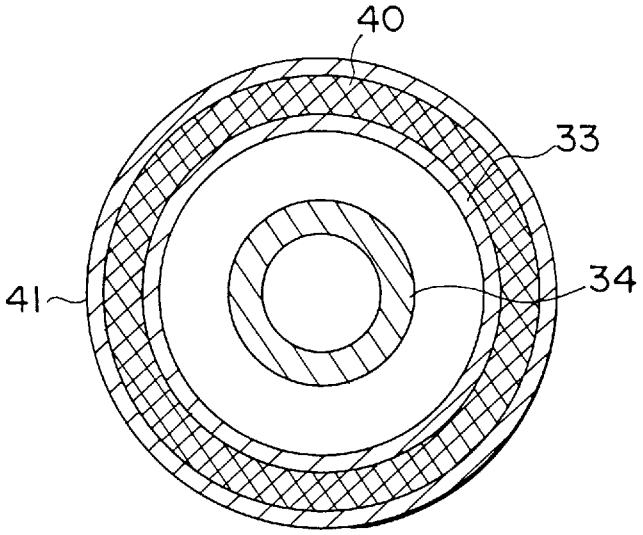
FIGS. 18A and 18B are a cross sectional view and a longitudinally sectional view respectively and schematically showing an important portion of an electrolysis bath shown in FIG. 17.
Figure 18B:
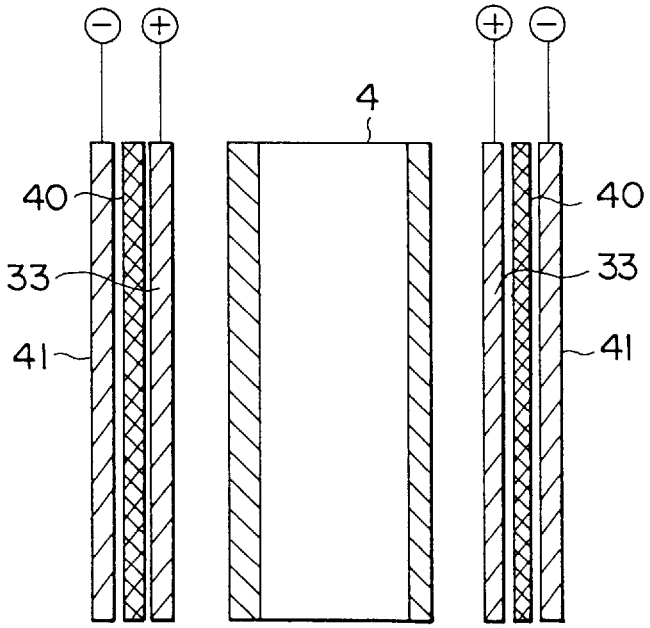
Figure 19:
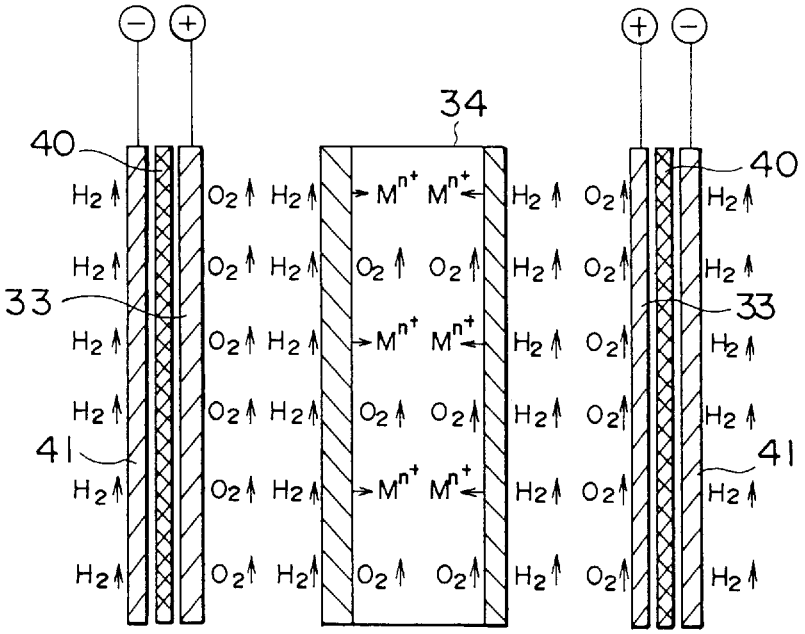
FIG. 19 is a model view for explaining an electrolysis reaction shown in FIG. 18B.

There is described a decontamination system for a radioactive metallic waste according to a tenth embodiment of the present invention with reference to FIGS. 17–19. FIG. 17 is a longitudinal sectional view of an example of an electrolysis bath in the system for explaining the tenth embodiment, in which a numeral 31 denotes an electrolysis bath into which an electrolyte 32 is filled.

There are provided in the electrolyte 32 a cylindrical electrode clamper 39 and the cylindrical metal 34 in the clamper 39. The metal 34 is fixed to the platform 36, and the cylindrical electrode clamper 39 is connected to the DC power source 37. Furthermore, the handling mechanism 38 is set over the electrolysis bath 31 in order to insert and take the cylindrical metal 34 into and out of the bath 31.

There is described in detail the cylindrical electrode clamper 39 with reference to FIGS. 18A and 18B, in which FIG. 18A is a plan view and FIG. 18B is a longitudinal section view. The cylindrical electrode clamper 39 is provided for holding the cylindrical anode 33 to the inner wall of a cylindrical insulating shield body 40 and the cylindrical cathode 41 to the outer wall of the cylindrical insulating shield body 41. The cylindrical metal 34 is set in the cylindrical anode 33, and the DC power source 37 is connected to the cylindrical anode 33 and the cylindrical cathode 41, respectively.

Under this condition, when the DC voltage having a predetermined current density is supplied to the cylindrical anode 33 and the cylindrical cathode 41, respectively, a reaction shown in FIG. 19 occurs at the surfaces of the cylindrical anode 33 and cylindrical cathode 41 and at the inner and outer surfaces of the cylindrical metal 34. The reaction has a principle represented by the equations (1'), (2'), (6) and (3'). The bar-shape cathode 41 represented by the equation (2') can be replaced by the cylindrical cathode.

Since the outer surface of the cylindrical metal 34 faces the cylindrical anode 33, the outer surface is charged by the dielectric function to the negative polarity, and the inner surface of the cylindrical metal 34 is divided in the polarity to be charged in the positive polarity, thereby dissolving the inner surface of the base metal.

By this, a dissolution of the base metal decontaminates a radioactivity which is fixed on the inner surface of the cylindrical metal 34 or soaked into the base metal from the metal 34 to move into the electrolyte 32, thereby decontaminating the radioactivity or decreasing the radioactivity level of the cylindrical metal 34.

Figure 20:
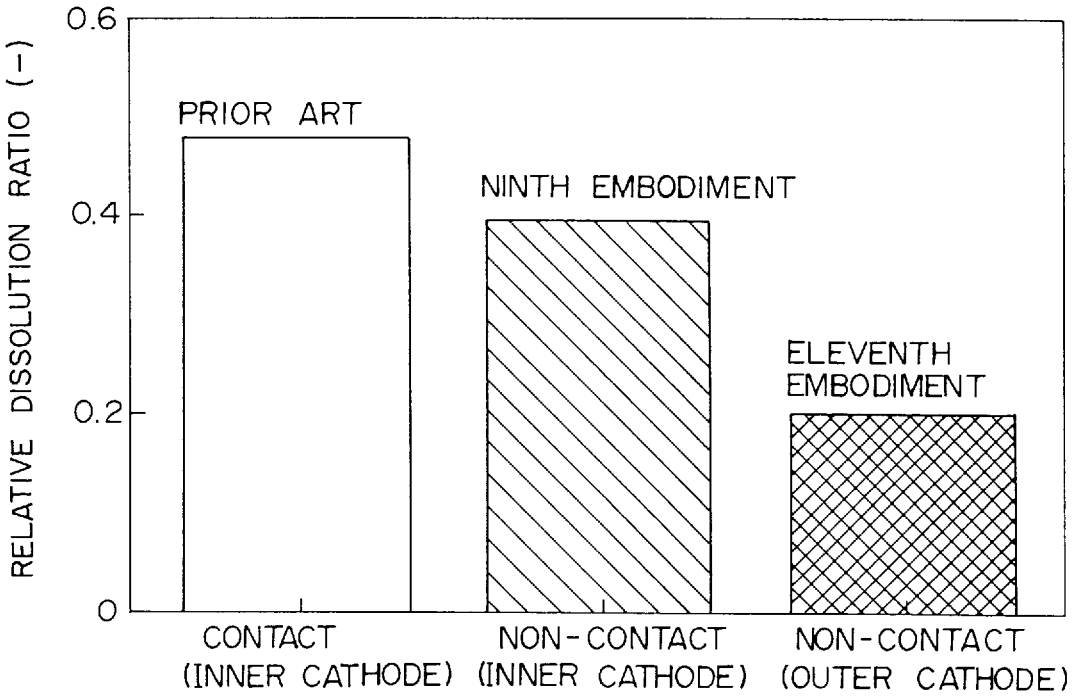
FIG. 20 is a bar graph showing both dissolution ratio of systems respectively according to ninth and eleventh embodiments of the present invention under a comparison with the prior art.

Next, there is described a decontamination system according to an eleventh embodiment of the present invention with reference to FIG. 20. FIG. 20 shows dissolution results of the inner surface of the cylindrical metal 34 formed of the stainless steel by the conventional contact electrolysis (an insert cathode), an insert cathode of the ninth embodiment, and an insert cathode of the tenth embodiment, by using a relative dissolution ratio (experiment/theory values). The theory value can be obtained by Faraday's law.

In the eleventh embodiment, phosphoric acid is selected as the electrolyte, in which the density of phosphoric acid is 40%, a temperature of the electrolyte is 60° C., and a DC voltage having a current density of 0.6 A/cm$^2$ is supplied to a portion between the anode and cathode formed of titanium coated by platinum so as to perform an electrolysis.

As clearly understood from the figures, even though a relative dissolution ratio of this embodiment is slower than that of the conventional contact electrolysis, since the inner surface of the cylindrical metal can be dissolved in the electrolysis method of the present invention, it is possible to decontaminate the radioactivity or decrease the radioactive level of the metallic waste.

As described above, since the ninth embodiment of the present invention can dissolve the inner surface of the curved metal without a connection between the cylindrical metal and the anode, it is possible to improve the work efficiency and to decrease an exposure amount for an operator. Furthermore, since the tenth embodiment of the present invention can dissolve the inner surface of the curved metal without an insertion of the cathode into the cylindrical metal, it is possible to easily insert and take the metal into and out of the electrolysis bath 31, to easily automate the system using the handling mechanism, and to further decrease the exposure amount for an operator.

Figure 21:
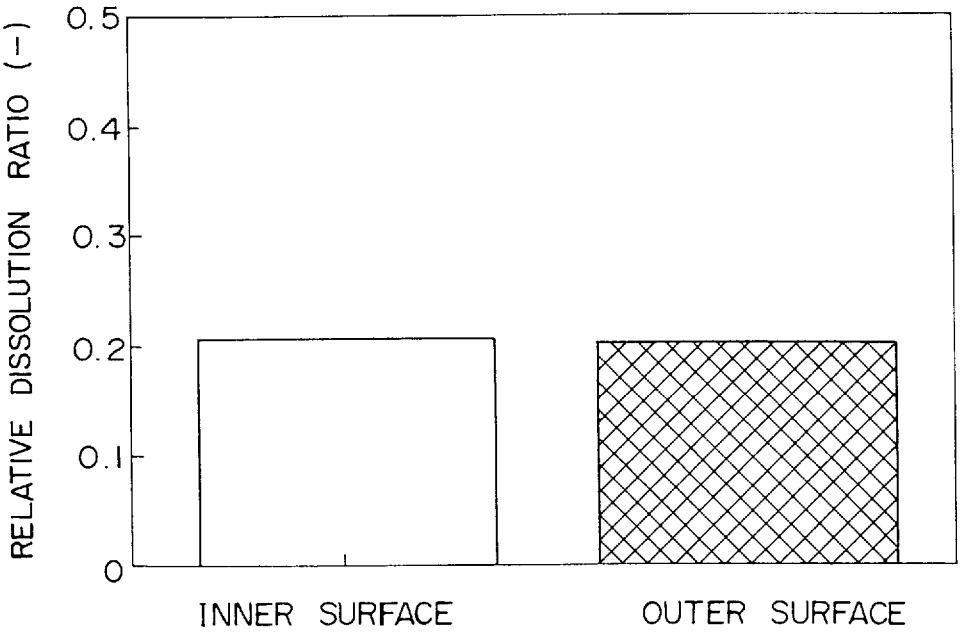
FIG. 21 is a bar graph showing a dissolution ratio on surfaces in comparison with an inner and outer in a system for decontaminating a radioactivity of a metallic waste according to a twelfth embodiment of the present invention.

Next, there is a provided system for decontaminating a radioactivity according to a twelfth embodiment of the present invention with reference to FIG. 21. FIG. 21 shows a relative dissolution ratio (experiment/theory values) as a dissolved result of the inner and outer surfaces of the cylindrical metal 34 formed of a stainless steel in the twelfth embodiment in which a polarity of DC current power source in the tenth embodiment is inverted. In the twelfth embodiment, the density of phosphoric acid is 40%, the temperature of the electrolyte is 60° C., and the current density is 0.6 A/cm$^2$, thereby performing an electrolysis by supplying a DC voltage to a portion between the anode and the cathode which are formed of titanium coated by platinum.

As understood from the twelfth embodiment, it is possible to dissolve the inner and outer surfaces of the cylindrical metal at substantially the same dissolution ratio by inverting a polarity of the DC power source. As described above, since only inversion of a polarity of the DC power source can dissolve the inner and outer surfaces of the cylindrical metal, it is possible to decontaminate a radioactivity and decrease a radioactive level of the cylindrical metal.

Next, there is described a decontamination system according to a thirteenth embodiment of the present invention with reference to FIGS. 14–15B. When the cylindrical metal 34 is a carbon steel, an oxide layer and rust are thickly and firmly formed on the surface of the base metal, and the oxide layer is hard to be dissolved by a simple anode electrolysis. Since radioactivity is almost included in the oxide layer, it takes a long time to decontaminate the radioactivity from the cylindrical metal 34.

It is effective that there is a method of alternatively inverting a polarity of the DC power source 37 for decontaminating in a short time the radioactivity of the cylindrical metal 34 of the carbon steel. A charge in the negative polarity to the inner surface (contaminated surface) of the cylindrical metal 34 of the carbon steel causes a reaction on the inner surface to occur so as to reduce the oxide layer and rust.

(Charged surface of negative polarity)

Reduction of oxide layer and rust:

$$Fe_3O_4+8H^++2e^-\rightarrow 3Fe^{2+}+4H_2O \quad (4)$$

$$Fe_2O_3+6H^++2e^-\rightarrow 2Fe^{2+}+3H_2O \quad (5)$$

In this manner, the oxide layer and rust are reduced and eliminated from the contaminated surface of the cylindrical metal 34, and at the same time the radioactivity in the oxide layer is decontaminated. Furthermore, since the polarity of the DC power source 37 is alternatively converted, the contaminated surface is also charged to the positive polarity so as to dissolve the base metal exposing after the oxide layer is removed, and to remove a contamination soaked into the base metal.

Accordingly, the radioactivity attached on or soaked into the base metal with the oxide layer of the cylindrical metal 34, can be decontaminated with little dissolution amount from the cylindrical metal 34 by reducing the oxide layer and dissolving the base metal to move into the electrolyte 32, thereby decontaminating the radioactivity and decreasing the radioactive level of the cylindrical metal 34, so as to decrease occurring amount of a secondary waste with the decontamination.

Figure 22A:
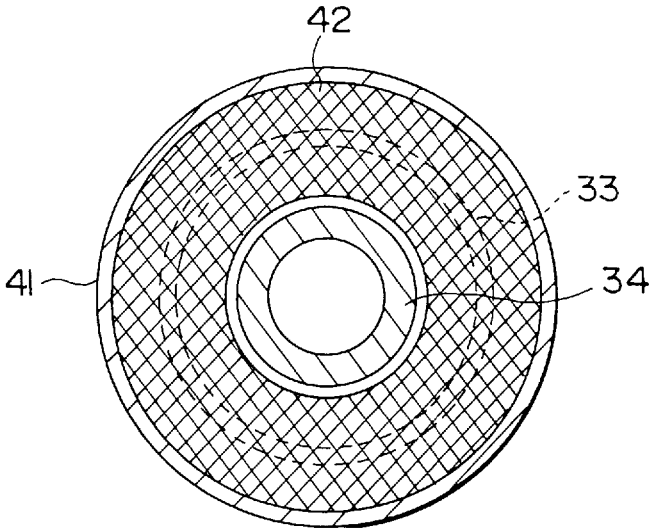
FIG. 22A is a schematic cross sectional view showing a system for decontaminating a radioactivity of a metallic waste according to a fourteenth embodiment.
Figure 22B:
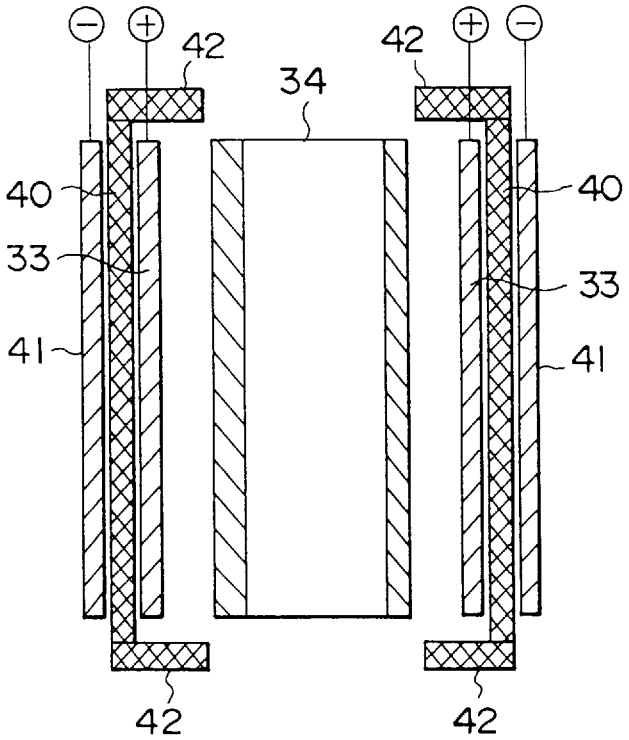
FIG. 22B is a schematic longitudinally sectional view showing the system shown in FIG. 22A.

Next, there is described a decontamination system for a radioactive metallic waste according to a fourteenth embodiment with reference to FIGS. 22A and 22B.

FIG. 22A is a plan view showing a condition in which an insulating discs 42 each having openings are attached at upper and lower portions of the cylindrical insulating shield body 40, and FIG. 22B is a longitudinal section view showing the above condition. A cylindrical anode 33 is arranged on the inner wall of the cylindrical insulating shield body 40, and a cylindrical cathode 41 is arranged on the outer wall of the cylindrical insulating shield body 40. The cylindrical metal 34 is set in the cylindrical anode 33, and a DC power source 37 is connected to the cylindrical anode 33 and the cylindrical cathode 41, respectively.

Under the condition, when a voltage having a predetermined current density is supplied from the DC power source 37 to a portion between the cylindrical anode 33 and the cylindrical cathode 41, the reaction explained by a theory of the equations (1'), (2'), (6) and (3') occurs to charge in a positive polar with the inner surface of the cylindrical metal 34, thereby dissolving the base metal arranged on the inner surface.

Figure 23:
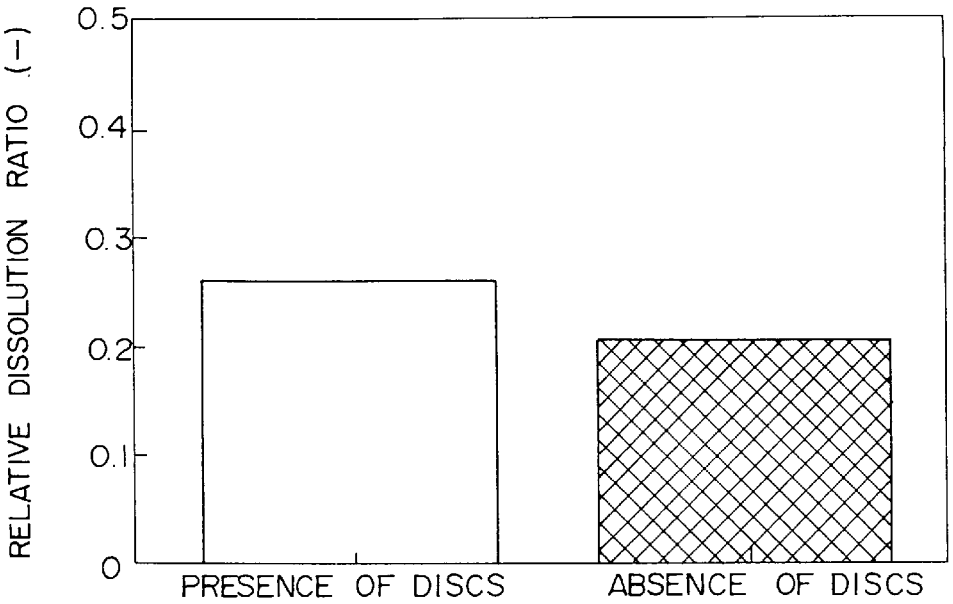
FIG. 23 is a bar graph showing a dissolution ratio under the comparison of a presence and absence of a disc in a system for decontaminating a radioactivity of a metallic waste according to a fifteenth embodiment of the present invention.

Next, there is described a decontamination system according to fifteenth embodiment of the present invention in reference with FIG. 23 showing each dissolution ratio (experiment/theory values) of results of dissolution the inner surface of the cylindrical metal 34 of the stainless steel according to the tenth and fourteenth embodiments, in which the tenth embodiment uses the cylindrical insulating shield body 40 and the fourteenth embodiment uses the shield body 40 and the insulating discs 42 each attached to the upper and lower ends of the body 40 and having opening.

In the fifteenth embodiment, phosphoric acid is selected as the electrolyte 32, and the electrolysis is performed under the condition that the density of phosphoric acid is 40%, the temperature is 60° C., the current density is 0.6 A/cm$^2$, thereby supplying the DC voltage to a portion between the cylindrical anode 33. and the cylindrical cathode 41 which is titanium coated by platinum.

As understood from FIG. 23, the relative dissolution ratio improves about 1.3 times by attaching the insulating discs 42 to the upper and lower ends of the cylindrical insulating shield body 40, respectively. There is a reason that the current leaking into a portion between the anode 33 and the cathode 41 is broken and the electrolysis is suppressed between the anode and cathode by means of an attachment of the insulating discs 42 respective to the upper and lower ends of the cylindrical insulating shield body 40.

As described above, since the insulating discs 42 are attached at the upper and lower ends of the cylindrical insulating shield body 40, respectively, it is possible to decontaminate in a short time a radioactivity of the cylindrical metal 34 and to decrease the radioactive level of the metal.

There is described a decontamination system according to a sixteenth embodiment with reference to FIG.

Figure 24:
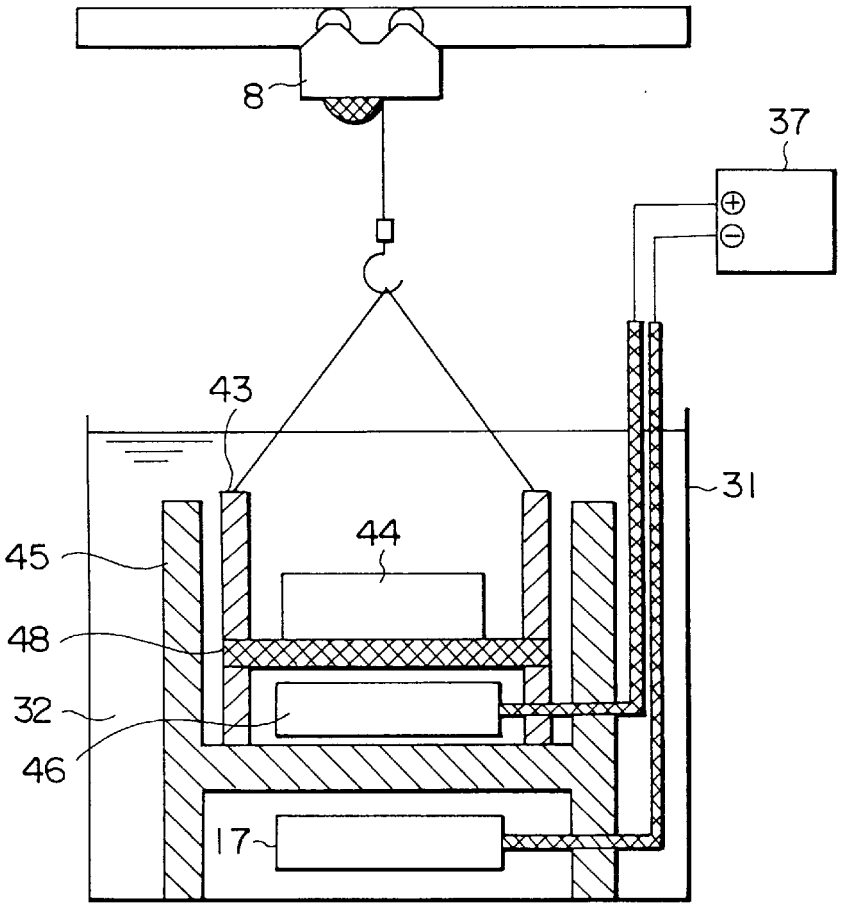
FIG. 24 is a system diagram schematically showing a system for decontaminating a radioactivity of a metallic waste according to a sixteenth embodiment of the present invention.

FIG. 24 is a longitudinal section view of the electrolysis bath 31 in the system according to the sixteenth embodiment, in which numeral 43 denotes a supporting vessel having an opening at its upper portion, and the supporting vessel 43 is hung down in the electrolysis bath 31 by a handling mechanism 38 which is set to the upper portion of the bath 31.

The supporting vessel 43 has a side surface formed of an insulating material and having a plurality of holes in a mesh-shape for the electrolyte flowing through and a bottom portion formed of a metal material 48, and stores a plate-shape metal 44 as the radioactive metallic waste therein.

The supporting vessel 43 is set in the insulating shield vessel 45 having an opening at its upper portion, the plate-shaped anode 46 is set to the bottom portion of the shield vessel 45, and the plate-shaped cathode 47 is set to the bottom portion of the electrolysis bath 31 through the bottom portion of the shield vessel 45.

Under the condition, when the DC voltage is supplied between the plate-shaped anode 46 and the plate-shaped cathode 47, since the potential difference occurs at both sides of the insulating shield vessel 45, the difference causes a surface of the metal material 48 provided at the bottom portion of the supporting vessel 43 facing to the plate-shaped anode 46 to be charged to the negative polarity. On the other hand, since the metal 44 contacts with the metal material 48 at the bottom portion of the supporting vessel 43, the polarity of the metal 44 is divided to charge in a positive polarity with the upper surface of the metal 44, thereby dissolving the base metal of the metal 44.

Figure 25A:
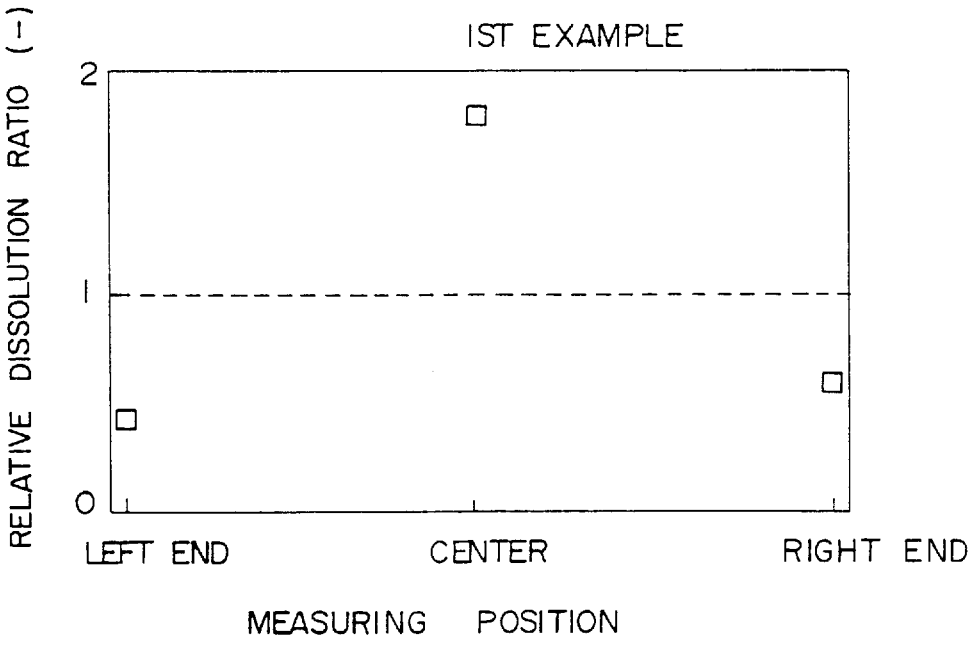
FIG. 25A is a solubility distribution characteristic diagram for explaining a first embodiment in a seventeenth embodiment of the present invention.
Figure 25B:
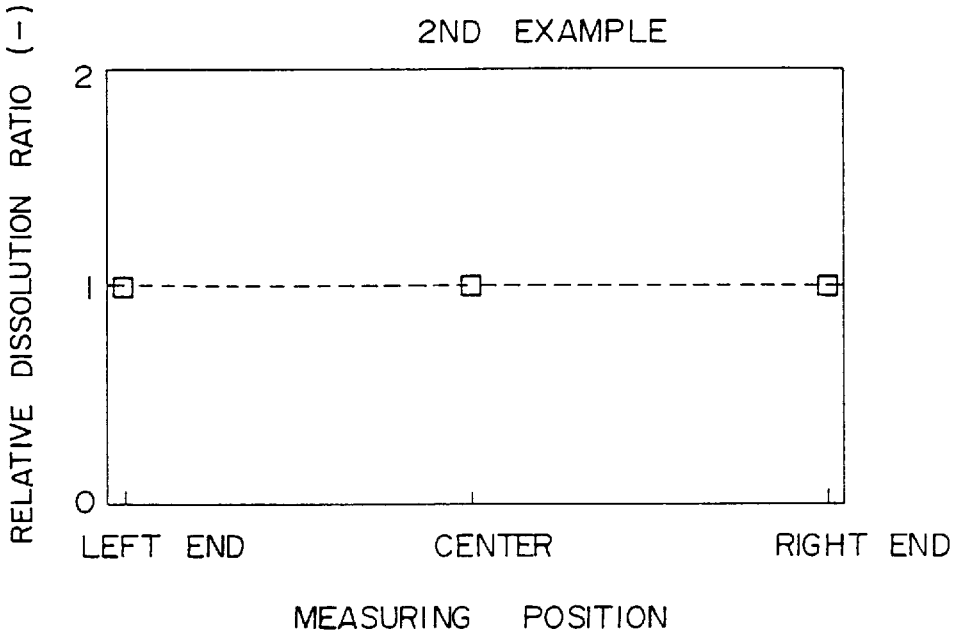
FIG. 25B is a solubility distribution characteristic diagram for explaining a second example of the seventeenth embodiment of the present invention.

Next, there is described a contamination system according to a seventeenth embodiment with reference to FIGS. 25A and 25B. FIG. 25A shows a relative dissolution distribution of the plate-shape stainless steel of a second example when the bottom portion is formed of a passive metal of titanium coated by platinum by a relative dissolution ratio (dissolution ratio at each position against a mean dissolution ratio), and FIG. 25A shows a dissolution distribution of the plate-shape stainless steel of a first example when the bottom portion is formed of the insulating material having a plurality of holes in a mesh-shape for passing the electrolysis therethrough by a relative dissolution ratio (dissolution ratio at each position against a mean dissolution ratio).

In the seventeenth embodiment, phosphoric acid is selected as the an acid electrolyte and an electrolysis is performed by supplying a DC voltage between the anode and cathode formed of titanium coated by platinum under the condition that a density of phosphoric acid is 40%, a temperature of the electrolyte is a room temperature, and a current density is 0.6 A/cm$^2$.

As understood from FIG. 25B, the surface of the stainless steel can be uniformly dissolved by constructing the bottom of the supporting vessel by a metal material. However, as understood from FIG. 25A, the end is hard to be dissolved when the bottom of the supporting vessel is made of the insulating material having the plurality of holes in the mesh-shape.

The reason is, even though it has been necessary to supply the potential larger than the equilibrium potential of the metal dissolution reaction to the surface of the metal when the metal is dissolved by a bipolar electrolytic with non-contact, that the potential at the end portion is low and the potential at the center of the metal surface is high by an influence of the leaking current between the anode and cathode.

As described above, when the bottom of the supporting vessel 43 is made of the metal material 48, since the metal surface can be uniformly dissolved, it is possible to uniformly decontaminate a metallic waste having a curved shape, a chip after cutting the metallic waste, and sundries such as tools, thereby removing a radioactivity and reducing a radioactive level of the metallic waste.

Furthermore, since the use of the supporting vessel having an insulation and an opening at its upper portion can increase a decontamination amount of the metallic waste per one batch, and can be inserted into and taken out of the electrolysis bath by using the driving mechanism, it is possible to easily utilize an automation for a mass processing.

In several embodiments mentioned above, even though phosphoric acid is used as the electrolyte, sulfuric acid, nitric acid, sodium sulfate and sodium nitrate can result the same effect.

Furthermore, in a decontamination system and method according to the present invention, since the electrolysis occurs at the wall surface of the electrolysis bath by a dielectric function when the material of the electrolysis bath is a metal, it is impossible to efficiently charge the surface of the metallic waste to a positive or negative polarity.

Accordingly, the system of the present invention uses an insulating material simple body having a drug resistance and heat resistance such as fluorocarbon polymers and FRP, or a metal lined by an insulating material for manufacturing the electrolysis bath, the insulating shield body and insulating discs for the cylindrical metallic waste, and the insulating shield vessel for the plate-shaped metallic waste.

Even though the openings of the insulating discs may have holes for allowing the cylindrical metal for an insertion, since the insertion is done through the upper disc, the lower disc is fixed and various types of the upper discs may be attached in the manner of matching a diameter of the opening with the outer diameter of the cylindrical metal.

The electrode can be made of copper lined by titanium, further coated by platinum, a simple platinum, a metal without titanium coated by platinum, and lead compound in addition to titanium coated by platinum utilized in the above-mentioned embodiments.

Furthermore, the supporting vessel for storing the metallic waste may be made of the above-mentioned electrode material, and may be lined its side surface by the insulating material having a drug resistance and heat resistance such as fluorocarbon polymers and fiber reinforced plastics (FRP).

What is claimed is:

1. A system for decontaminating radioactivity of a metallic waste comprising:

an electrolysis bath adapted to be filled with an electrolyte which has a component, density and temperature for performing electrolysis of a radioactive metallic waste;

an anode arranged in said electrolysis bath and charged in a positive polarity by a direct current (DC) voltage supplied from a DC power source;

a cathode arranged in said electrolysis bath and charged in a negative polarity by said DC voltage supplied from said DC power source;

a shielded vessel for dividing said electrolysis bath into an anode chamber and a cathode chamber, wherein said shielded vessel is set in a U-shape along three inner wall surfaces of said electrolysis bath; and an insulating basket arranged in said shielded vessel adapted for storing a radioactive metallic waste, said insulating basket having an opening at an upper portion thereof.

2. The system for decontaminating radioactivity of a metallic waste according to claim 1, wherein said shielded vessel has an opening at an upper portion thereof, wherein said anode is arranged at a bottom portion of said electrolysis bath, wherein said cathode is arranged at a bottom portion of said shielded vessel, and wherein said insulating basket is arranged between said cathode and metallic waste in said cathode chamber and has a plurality of holes for allowing passage of an electrolyte therethrough.

3. The system for decontaminating radioactivity of a metallic waste according to claim 2, wherein said basket has an opening at an upper portion thereof.

4. The system for decontaminating radioactivity of a metallic waste according to claim 1, wherein said cathode is comprised of a rectangular pipe or a bar-shaped body, and further comprsing a driving mechanism for moving said cathode at a constant distance from a metallic waste contained in said basket.

5. The system for decontaminating radioactivity of a metallic waste according to claim 4, wherein said cathode is comprised of a blind-shaped cathode which is formed by connecting a plurality of rectangular pipes or bar-shaped bodies by a flexible cable, said blind-shaped cathode having an insulating elastic body for allowing water to pass therethrough.

6. A method of decontaminating radioactivity of a metallic waste, comprising:

a step of performing a bipolar electrolysis in which the metallic waste is not contacted by an electrolyte provided in an electrolysis bath;

a step of dissolving a base metal of the metallic waste by dissolving the base metal of the metallic waste by a dielectric function, thereby eliminating radioactivity;

a step of setting said metallic waste at a position between a pair of electrodes including an anode and cathode and corresponding to a shape of said metallic waste;

a step of supplying a direct current (DC) voltage from a DC power source to said pair of electrodes to charge said anode in a positive polarity and to charge said cathode in a negative polarity for performing said electrolysis, thereby dissolving said base metal of said metallic waste;

a step of dividing the electrolysis bath into an insulating shield plate, an anode chamber and a cathode chamber;

a step of setting said anode in said anode chamber;

a step of setting said cathode and said metallic waste in said cathode chamber;

a step of supplying said DC voltage to said anode and cathode from said DC power source connected to said anode and cathode, respectively; and a step of charging in a positive polarity a first decontamination surface of said metallic waste facing said cathode.

7. The method of decontaminating radioactivity of a metallic waste according to claim 6, wherein when entire surfaces of said metallic waste are contaminated by the radioactivity, a polarity of said DC power source is converted to change said anode to a cathode and said cathode to an anode so as to dissolve a second decontamination surface of said metallic waste.

8. The method of decontaminating radioactivity of a metallic waste according to claim 6, further comprising:

a step of using inorganic acid as said electrolyte;

a step of supplying said DC voltage to said pair of electrodes;

a step of reducing and destroying a passive or oxide layer on said first decontamination surface of said metallic waste facing said cathode by charging in a negative polar to the other surface of said predetermined surface; and a step of stopping a supply of said DC voltage and dissolving said base metal of said metallic waste using said inorganic acid.

9. The method of decontaminating radioactivity of a metallic waste according to claim 8, wherein a dissolution of said base metal and a reduction and destruction of said passive or oxide layer are repeated by alternatively inverting a polarity of said DC power source.

10. A method of decontaminating radioactivity of metallic waste comprising:

a step of performing electrolysis in which the metallic waste is not contacted by an electrode provided in an electrolysis bath;

a step of dissolving a base metal of the metallic waste by a dielectric function, thereby eliminating radioactivity;

a step of setting said metallic waste at a position between a pair of electrodes including an anode and cathode and corresponding to a shape of said metallic waste;

a step of supplying a direct current (DC) voltage from a DC power source to said pair of electrodes to charge said anode in a positive polarity and to charge said cathode in a negative polarity for performing said electrolysis, thereby dissolving said base metal of said metallic waste;

a step of setting a cylindrical anode in said electrolyte;

a step of setting a cylindrical metallic waste in said cylindrical anode;

a step of setting a bar-shape cathode in said cylindrical metallic waste;

a step of supplying said DC voltage from said DC power source to a portion between said cylindrical anode and said bar-shape cathode; and a step of charging in a positive polarity an inner surface of said cylindrical metallic waste and in negative polarity an outer surface of said cylindrical metallic waste, thereby dissolving said inner surface of the base metal of said metallic waste.

11. The method of decontaminating radioactivity of the metallic waste according to claim 10, wherein when both of said inner surface and said outer surface of said cylindrical metallic waste are contaminated, a cathode of said DC power source is inverted to an anode, and an anode of said DC power source is inverted to a cathode, thereby dissolving said outer surface of said cylindrical metallic waste.

12. The method of decontaminating radioactivity of the metallic waste according to claim 10, wherein a dissolution of said base metal of said inner surface of said cylindrical metallic waste and a reduction and destruction of said oxide layer formed on said inner surface of said cylindrical metallic waste are repeated by alternatively inverting a polarity of said DC power source.

13. A method of decontaminating radioactivity of a metallic waste comprising:

a step of performing a bipolar electrolysis in which the metallic waste is not contacted by an electrolyte provided in an electrolysis bath;

a step of dissolving a base metal of the metallic waste by a dielectric function, thereby eliminating radioactivity;

a step of setting said metallic waste at a position between a pair of electrodes including an anode and cathode and corresponding to a shape of said metallic waste;

a step of supplying a direct current (DC) voltage from a DC power source to said pair of electrodes to charge said anode in a positive polarity and to charge said cathode in a negative polarity for performing said electrolysis, thereby dissolving said base metal of said metallic waste;

a step of setting a cylindrical insulating shield body in said electrolyte;

a step of setting a cylindrical anode on an inner wall of said cylindrical insulating shield body;

a step of setting a cylindrical cathode on an outer wall of said cylindrical insulating shield body;

a step of setting a cylindrical metallic waste in said cylindrical anode;

a step of connecting said DC power source to said cylindrical anode and said cylindrical cathode;

a step of supplying said DC voltage from said DC power source to said cylindrical anode and cylindrical cathode; and a step of charging in a negative polarity an outer surface of said cylindrical metallic waste and in a positive polarity an inner surface of said cylindrical metallic waste, thereby dissolving the base metal at an inner surface of said cylindrical metallic waste.

14. The method of decontaminating radioactivity of a metallic waste according to claim 13, wherein when both of said inner surface and said outer surface of said cylindrical metallic waste are contaminated, a cathode of said DC power source is inverted to an anode, and an anode of said DC power source is inverted to a cathode, thereby dissolving said outer surface of said cylindrical metallic waste.

15. The method of decontaminating radioactivity of a metallic waste according to claim 13, wherein a dissolution of said base metal of said inner surface of said cylindrical metallic waste and a reduction and destruction of said oxide layer formed on said inner surface of said cylindrical metallic waste are repeated by alternatively inverting a polarity of said DC power source.

* * * * *